US009243398B2

(12) United States Patent
Liberman

(10) Patent No.: US 9,243,398 B2
(45) **Date of Patent: *Jan. 26, 2016**

(54) MODULAR BUILDING SYSTEM FOR CONSTRUCTING MULTI-STORY BUILDINGS

(71) Applicant: Barnet L. Liberman, New York, NY (US)

(72) Inventor: Barnet L. Liberman, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/531,637

(22) Filed: Nov. 3, 2014

(65) Prior Publication Data

US 2015/0113892 A1 Apr. 30, 2015

Related U.S. Application Data

(63) Continuation of application No. 13/379,883, filed as application No. PCT/US2010/039485 on Jun. 22, 2010, now Pat. No. 8,919,058.

(60) Provisional application No. 61/219,048, filed on Jun. 22, 2009, provisional application No. 61/269,322, filed on Jun. 23, 2009.

(51) Int. Cl.
*E04H 1/00* (2006.01)
*E04G 21/14* (2006.01)
(Continued)

(52) U.S. Cl.
CPC ..... *E04B 1/34823* (2013.01); *E04B 1/34331* (2013.01); *E04B 1/34384* (2013.01);
(Continued)

(58) Field of Classification Search
CPC ..... E04B 1/34823; E04B 1/48; E04B 5/04; E04B 2001/34892; E04B 1/483; E04B 1/34384; E04B 1/34331; E04F 17/005; E04G 21/142; E04G 21/14
USPC ..... 52/122.1, 125.4, 236.3, 583.1, 79.1, 52/79.2, 79.3, 79.7, 79.8, 79.9, 79.11, 52/79.13, 251, 252, 253, 283
See application file for complete search history.

(56) References Cited

U.S. PATENT DOCUMENTS 1,516,074 A 11/1924 Borg ..... 52/236.9
1,960,575 A 5/1934 Davison
(Continued)

FOREIGN PATENT DOCUMENTS

EP 1857662 A2 11/2007
WO WO 2008124003 A1 10/2008

OTHER PUBLICATIONS

International Preliminary Report on Patentability for PCT/US2010/039485 dated Jan. 4, 2012 (7 pages).

*Primary Examiner* — Rodney Mintz
(74) *Attorney, Agent, or Firm* — Cozen O'Connor

(57) ABSTRACT

A modular building system for constructing a multi-story building includes prefabricated modular units. Each modular unit includes a horizontal slab for forming a floor/ceiling of the building, a joist extending horizontally along a first edge of the slab, the joist extending below the slab and extending horizontally beyond the first edge of the slab to form a receiving lip, columns positioned on top of the slab along the first edge, and connectors installed in cavities formed in the unit. A floor of the multi-story building is formed by arranging the modular units so that the slab of a first modular unit is positioned on the receiving lip of a second modular unit. An additional floor of the multi-story building is formed by arranging the modular units so that the joist portion of an upper modular unit is positioned on the columns of a lower modular unit.

23 Claims, 25 Drawing Sheets

(51) Int. Cl.

| | |
|---|---|
| ***E04B 1/348*** | (2006.01) |
| ***E04B 5/04*** | (2006.01) |
| ***E04B 1/343*** | (2006.01) |
| ***E04B 1/48*** | (2006.01) |
| ***E04F 17/00*** | (2006.01) |

(52) U.S. Cl.

CPC ..... *E04B 1/48* (2013.01); *E04B 1/483* (2013.01); *E04B 5/04* (2013.01); *E04F 17/005* (2013.01); *E04G 21/14* (2013.01); *E04G 21/142* (2013.01); *E04B 2001/34892* (2013.01)

(56) References Cited

U.S. PATENT DOCUMENTS

| | | | | |
|---|---|---|---|---|
| 2,078,069 | A | 4/1937 | Eliel | 52/293.2 |
| 2,387,659 | A | 10/1945 | Hafsos | |
| 2,543,692 | A | 2/1951 | Glover | |
| 2,592,634 | A | 4/1952 | Wilson | |
| 2,611,262 | A | 9/1952 | Dodson et al. | |
| 2,783,638 | A | 3/1957 | Henderson | 52/252 |
| 2,819,692 | A | 1/1958 | Johnson et al. | |
| 2,920,475 | A | 1/1960 | Graham | |
| 3,162,863 | A | 12/1964 | Wokas | 52/34 |
| 3,230,683 | A | 1/1966 | Foster | |
| 3,243,927 | A | 4/1966 | Hilson | 52/169.9 |
| 3,261,135 | A | 7/1966 | Knabe | |
| 3,354,593 | A | 11/1967 | Zukas | |
| 3,369,334 | A | 2/1968 | Berg | |
| 3,372,519 | A | 3/1968 | Russell | |
| 3,487,597 | A | 1/1970 | Gutt | 52/73 |
| 3,494,092 | A | 2/1970 | Bottjer et al. | 52/745.14 |
| 3,566,558 | A | 3/1971 | Fisher | 52/73 |
| 3,566,560 | A * | 3/1971 | Wakefield et al. | 52/127.12 |
| 3,596,417 | A | 8/1971 | Zachry | 52/73 |
| 3,604,177 | A | 9/1971 | Clyne et al. | 52/283 |
| 3,621,626 | A | 11/1971 | Adolfo | |
| 3,635,354 | A * | 1/1972 | Martin | 211/194 |
| 3,642,339 | A * | 2/1972 | Ruderfer | 312/283 |
| 3,713,259 | A | 1/1973 | Tkach | |
| 3,714,304 | A | 1/1973 | Carner et al. | 264/572 |
| 3,724,141 | A | 4/1973 | Kelleher | 52/79.11 |
| 3,745,731 | A | 7/1973 | Simpson et al. | 52/236.6 |
| 3,762,115 | A | 10/1973 | McCaul, III et al. | |
| 3,782,061 | A | 1/1974 | Minutoli et al. | 52/125.5 |
| 3,818,660 | A | 6/1974 | Dillon | 52/251 |
| 3,828,512 | A | 8/1974 | Johnson | 52/745.11 |
| 3,830,025 | A | 8/1974 | Wainshal | 52/79.11 |
| 3,831,332 | A | 8/1974 | Weese | |
| 3,894,373 | A | 7/1975 | Willingham | 52/236.3 |
| 3,959,423 | A * | 5/1976 | Boyd | 264/34 |
| 3,965,627 | A | 6/1976 | Fencl | 52/79.13 |
| 3,969,872 | A * | 7/1976 | Wesse | 52/745.03 |
| 3,991,528 | A | 11/1976 | Dillon | 52/79.9 |
| 3,999,355 | A | 12/1976 | Stucky | 52/745.03 |
| 4,010,579 | A | 3/1977 | Galvagni | 52/79.8 |
| 4,023,315 | A | 5/1977 | Stucky | 52/79.13 |
| 4,048,772 | A * | 9/1977 | Gaul | 52/136 |
| 4,060,948 | A | 12/1977 | Brownlee | 52/236.8 |
| 4,065,907 | A | 1/1978 | Rice | 52/745.13 |
| 4,068,425 | A | 1/1978 | Czorniak | 52/136 |
| 4,081,936 | A | 4/1978 | Wise | 52/301 |
| 4,099,360 | A * | 7/1978 | Outram | 52/745.18 |
| 4,184,296 | A | 1/1980 | Vitalini | 52/79.4 |
| 4,191,002 | A | 3/1980 | Rice | 52/745.03 |
| 4,194,339 | A | 3/1980 | Fisher | 52/745.03 |
| 4,214,413 | A * | 7/1980 | Gonzalez Espinosa de Los Monteros | 52/236.1 |
| 4,250,671 | A | 2/1981 | Hirsch et al. | 52/167.3 |
| 4,263,757 | A * | 4/1981 | Thys | 52/79.1 |
| 4,277,921 | A * | 7/1981 | Gianfranco | 52/79.4 |
| 4,282,690 | A | 8/1981 | Meheen | |
| 4,302,915 | A | 12/1981 | Stocks | 52/175 |
| 4,408,434 | A | 10/1983 | Collins | 52/745.2 |
| 4,441,286 | A | 4/1984 | Skvaril | |
| 4,461,130 | A * | 7/1984 | Shubow | 52/236.8 |
| 4,527,363 | A | 7/1985 | Saether | 52/122.1 |
| 4,528,793 | A | 7/1985 | Johnson | |
| 4,557,099 | A | 12/1985 | Johnson | 52/745.14 |
| 4,558,797 | A | 12/1985 | Mitchell | |
| 4,583,336 | A | 4/1986 | Shelangoskie et al. | 52/250 |
| 4,603,522 | A | 8/1986 | Johnson | 52/125.4 |
| 4,640,070 | A | 2/1987 | Moffat | 52/236.3 |
| 4,640,214 | A | 2/1987 | Bruns | 114/263 |
| 4,658,551 | A | 4/1987 | Roux | 52/79.1 |
| 4,694,621 | A | 9/1987 | Locke | 52/79.13 |
| 4,726,316 | A | 2/1988 | Bruns | 114/263 |
| 4,788,802 | A | 12/1988 | Wokas | |
| 4,907,660 | A | 3/1990 | Staggs et al. | |
| 4,945,695 | A * | 8/1990 | Majurinen | 52/252 |
| 4,989,382 | A * | 2/1991 | Spronken | 52/252 |
| 5,044,134 | A | 9/1991 | Brockway | 52/79.1 |
| 5,081,805 | A | 1/1992 | Jazzar | 52/79.2 |
| 5,088,263 | A | 2/1992 | Horii et al. | 52/745.13 |
| 5,123,220 | A | 6/1992 | Simenoff | 52/252 |
| 5,152,118 | A | 10/1992 | Lancelot | 52/848 |
| 5,177,913 | A | 1/1993 | Erel | 52/79.1 |
| 5,216,860 | A | 6/1993 | Thomson et al. | |
| 5,243,794 | A | 9/1993 | Pikor | 52/136 |
| 5,261,198 | A | 11/1993 | McMillan | 52/127.12 |
| 5,267,419 | A | 12/1993 | Yokota et al. | |
| 5,305,563 | A | 4/1994 | Erel | 52/79.2 |
| 5,351,454 | A | 10/1994 | Hahne et al. | 52/309.17 |
| 5,366,672 | A | 11/1994 | Albrigo et al. | |
| 5,412,913 | A | 5/1995 | Daniels et al. | 52/79.13 |
| 5,491,942 | A | 2/1996 | Prokasky | 52/236.3 |
| 5,528,866 | A | 6/1996 | Yulkowski | 52/79.12 |
| 5,586,834 | A | 12/1996 | Tsuji | 404/60 |
| 5,596,853 | A | 1/1997 | Blaney et al. | 52/223.7 |
| 6,065,263 | A | 5/2000 | Taguchi | |
| 6,073,401 | A * | 6/2000 | Iri et al. | 52/79.1 |
| 6,074,101 | A | 6/2000 | Bloom | |
| 6,119,413 | A | 9/2000 | Shaw et al. | 52/167.1 |
| 6,195,955 | B1 | 3/2001 | Kostopoulos | |
| 6,237,297 | B1 | 5/2001 | Paroly | |
| 6,327,829 | B1 | 12/2001 | Taguchi | 52/583.1 |
| 6,367,214 | B1 | 4/2002 | Monachino | |
| 6,431,797 | B2 | 8/2002 | Greenberg | 405/284 |
| 6,434,900 | B1 | 8/2002 | Masters | 52/283 |
| 6,493,996 | B1 | 12/2002 | Alexander et al. | 52/79.9 |
| 6,505,450 | B1 | 1/2003 | Locke et al. | 52/514.5 |
| 6,588,296 | B2 | 7/2003 | Wessel | |
| 6,658,799 | B1 | 12/2003 | Stoodley | 52/79.2 |
| 6,826,879 | B1 | 12/2004 | Allen et al. | 52/236.3 |
| 6,871,453 | B2 | 3/2005 | Locke | 52/79.13 |
| 6,925,761 | B1 | 8/2005 | De La Marche | 52/79.7 |
| 6,978,572 | B1 | 12/2005 | Bernklau et al. | |
| 7,033,116 | B1 | 4/2006 | Ward et al. | |
| 7,121,061 | B2 | 10/2006 | Jazzar | 52/745.13 |
| 7,143,559 | B1 | 12/2006 | Ritter | 52/309.7 |
| 7,444,793 | B2 | 11/2008 | Raftery et al. | 52/741.14 |
| 7,921,609 | B2 | 4/2011 | Kordelin | 52/79.9 |
| 7,941,975 | B2 | 5/2011 | Ingjaldsdottir et al. | 52/79.12 |
| 8,011,147 | B2 | 9/2011 | Hanlan | 52/252 |
| 8,074,414 | B2 | 12/2011 | Carrion et al. | 52/236.3 |
| 8,166,714 | B2 | 5/2012 | Ziegelman | 52/79.2 |
| 8,341,902 | B2 | 1/2013 | Kusuma | 52/236.3 |
| 8,397,467 | B2 * | 3/2013 | Krell | 52/745.11 |
| 8,429,871 | B2 | 4/2013 | Ingjaldsdottir et al. | 52/582.1 |
| 8,434,280 | B2 | 5/2013 | Liberman | 52/259 |
| 8,479,471 | B2 | 7/2013 | Liberman | 52/741.1 |
| 8,756,898 | B1 | 6/2014 | Backhaus et al. | 52/745.2 |
| 8,844,242 | B2 * | 9/2014 | Liberman | 52/742.16 |
| 8,898,992 | B2 * | 12/2014 | Rahimzadeh et al. | 52/655.1 |
| 8,919,058 | B2 * | 12/2014 | Liberman | 52/283 |
| 2003/0019167 | A1 | 1/2003 | Baume et al. | 52/79.1 |
| 2003/0101680 | A1 | 6/2003 | Lee | 52/745.2 |
| 2004/0083663 | A1 | 5/2004 | Englekirk et al. | 52/236.3 |
| 2004/0118080 | A1 | 6/2004 | Jazzar | 52/745.19 |
| 2004/0182016 | A1 | 9/2004 | Locke | 52/79.13 |
| 2005/0044809 | A1 | 3/2005 | Thompson | |
| 2005/0115164 | A1 | 6/2005 | Han | 52/79.1 |
| 2005/0204687 | A1 | 9/2005 | Raftery et al. | 52/741.1 |
| 2005/0210762 | A1 | 9/2005 | Broberg | 52/79.1 |

(56) References Cited

U.S. PATENT DOCUMENTS

| | | | | |
|---|---|---|---|---|
| 2005/0217190 | A1 | 10/2005 | Simmons | 52/20.1 |
| 2005/0241918 | A1 | 11/2005 | Alldredge et al. | |
| 2006/0196132 | A1 | 9/2006 | Ruano | 52/26.3 |
| 2006/0283105 | A1 | 12/2006 | Bertrand | 52/122.1 |
| 2006/0288657 | A1 | 12/2006 | Jaecklin | 52/236.3 |
| 2007/0044392 | A1 | 3/2007 | LeBlang | 52/79.11 |
| 2008/0016805 | A1 | 1/2008 | Walter | 52/263 |
| 2008/0060293 | A1* | 3/2008 | Hanlon | 52/251 |
| 2008/0236090 | A1 | 10/2008 | Liberman | |
| 2009/0094915 | A1 | 4/2009 | Liberman | 52/293.3 |
| 2010/0132271 | A1 | 6/2010 | Fernandez Fernandez | 52/79.9 |
| 2010/0325987 | A1 | 12/2010 | Ely, Jr. | 52/236.3 |
| 2011/0023383 | A1 | 2/2011 | Brouillard | 52/79.9 |
| 2011/0047889 | A1 | 3/2011 | Gad et al. | 52/79.1 |
| 2011/0162293 | A1 | 7/2011 | Levy et al. | 52/79.9 |
| 2011/0173907 | A1 | 7/2011 | Katsalidis | 52/236.3 |
| 2011/0225905 | A1 | 9/2011 | Kusuma | 52/174 |
| 2011/0289862 | A1 | 12/2011 | Larouche et al. | 52/122.1 |
| 2011/0296769 | A1 | 12/2011 | Collins et al. | 52/79.1 |
| 2011/0296791 | A1* | 12/2011 | Finn | 52/745.21 |
| 2012/0023840 | A1 | 2/2012 | Yuan | 52/122.1 |
| 2012/0096634 | A1 | 4/2012 | Schultz et al. | 4/506 |
| 2012/0110928 | A1* | 5/2012 | Liberman | 52/122.1 |
| 2013/0263551 | A1* | 10/2013 | Liberman | 52/742.16 |
| 2015/0013255 | A1* | 1/2015 | Hunt | 52/236.3 |

* cited by examiner

MODULAR BUILDING SYSTEM FOR CONSTRUCTING MULTI-STORY BUILDINGS

CROSS REFERENCE TO RELATED APPLICATIONS

This application is a continuation of U.S. patent application Ser. No. 13/379,883 which was filed with the U.S. Patent and Trademark Office on Dec. 21, 2011 as a national stage of Patent Cooperation Treaty Application No. PCT/US2010/039485, filed on Jun. 22, 2010, which claimed priority to U.S. Provisional Patent Application No. 61/219,048, filed Jun. 22, 2009 and U.S. Provisional Patent Application No. 61/269,322, filed Jun. 23, 2009. These applications are incorporated herein by reference in their entirety.

BACKGROUND OF THE INVENTION

1. Field of the Invention

The invention relates generally to modular building systems, and more particularly to a modular building system for constructing multi-story buildings using prefabricated, precast concrete modular units that are disassembleable and repurposable.

2. Description of the Related Art

Modular units are commonly used for constructing residential and industrial structures because they can be partially assembled/constructed remote from the building site and transported via train, truck, or ship to the building site for assembly into a complete structure, such as an office building, for example. However, once the modular units are assembled into complete structures, the modular units cannot later be disassembled and reused in another structure or disassembled into repurposable or recyclable components. Further, in existing buildings constructed from modular units, the shear walls are not modular and instead must be constructed on site. Such non-modular shear walls are constructed by placing rods, beams, or a wire grid and pouring concrete on site, and thus cannot be disassembled and reused. Conventional modular units are typically in the form of a "box" that includes a floor and ceiling and external walls. Forming a structure from such units necessarily results in redundant floor, ceiling, and wall elements between units, which is inefficient.

Consequently, many otherwise sound modular units are wasted because they cannot be disassembled without being damaged or destroyed. Moreover, conventional modular units require some type of additional frame to support the modular units once they are stacked on top of, and next to, one another. Additionally, during assembly of the completed modular units into the final structure, wet trades must be employed at the construction site to couple the individual modular units together. Such connected modular units cannot be disassembled for reuse.

Currently, when modular units are assembled together at a construction site, a crane must lift and move the modular unit to an assembly position and hold the modular unit in position so that the modular unit can be connected to another modular unit. Scaffolds are typically constructed or moved around the modular unit to enable workmen to access the connection points of the modular units. For example, the connection point for a column is at the top of the column when the column is standing vertically. The process of moving/assembling various scaffolds around the construction site is time consuming, costly, and dangerous.

SUMMARY OF THE INVENTION

In one aspect, the present invention provides a modular building system for constructing a multi-story building. The system includes prefabricated modular units, each modular unit including a horizontal slab for forming a floor/ceiling of the building and a joist portion extending horizontally along a first edge of the slab. The joist portion extends below the slab and has a portion that extends horizontally beyond the first edge of the slab to form a receiving lip. Columns are positioned on top of the slab along the first edge. Connectors are installed in cavities formed in the modular unit.

At least one floor of the multi-story building is formed by arranging the modular units so that the slab of a first modular unit is positioned on the receiving lip of a second modular unit. At least one additional floor of the multi-story building is formed by arranging the modular units so that the joist portion of an upper modular unit is positioned on the columns of a lower modular unit.

Embodiments of the present invention may include one or more of the following features. The modular units may be formed of cast concrete.

The columns may be cast as part of the modular unit or may be cast separately from the modular unit and attached to the modular unit. One of the columns may include a connector arrangement including a cavity that passes completely through the column for receiving a connecting element, the connecting element being movable within the cavity.

The joist portion may be cast as part of the modular unit or may be cast separately from the modular unit and attached to the modular unit.

The connectors of the modular unit may include a connecting element fixed within the cavity of the connector. The connecting elements may be arranged such that the connecting elements of the connectors of adjacent modular units can be joined with a coupler. The connecting element may be a threaded rod. The coupler may be configured to allow connected ends of the coupler to move with respect to one another.

The modular units may include prefabricated walls connected to the columns of the modular unit. The wall may have a connector arrangement including a cavity that passes completely through the wall for receiving a connecting element, the connecting element being movable within the cavity. The walls may be arranged to form a utilities section between two parallel walls at an end of the modular unit.

In other embodiments, the present invention may include a hoist frame having a first end configured to attach to the columns of the modular unit, supports configured to hold a second, opposite end of the hoist frame in position above the slab, and ties attached to the hoist frame and configured to attach to the slab of the modular unit. Connectors may be positioned at pick points of the hoist frame, the connectors being configured to secure crane cables for lifting the modular unit. The hoist frame may include an access way arranged between the tops of the columns.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, like reference characters refer to the same parts throughout the different views. Also, the drawings are not necessarily to scale, emphasis instead generally being placed upon illustrating the principles of the invention.

DETAILED DESCRIPTION OF THE PRESENTLY PREFERRED EMBODIMENTS

The present invention involves a precast concrete modular building system for constructing buildings. The individual modular units are preformed and prefabricated at a factory and shipped via truck, train, or ship to a construction site. The individual modular units are stacked next to, and on top of, one another and coupled together to form a final structure, such as a multi-story office building, or apartment building. The individual modular units are self-supporting and include load-bearing members so that the structure can be completed without additional steel or a concrete frame. Further, the modular units are coupled together using various means that allow them to be easily separated/disassembled at a later time for the purpose of being reused in another structure or for the components of the modular units to be recycled. Consequently, no wet trades (i.e., cement) are used in the assembly of the final structure. The system is adaptable to a variety of multi-tier building types including residential, hotel, motel, dormitory, office, school, and hospital buildings.

Figure 1:
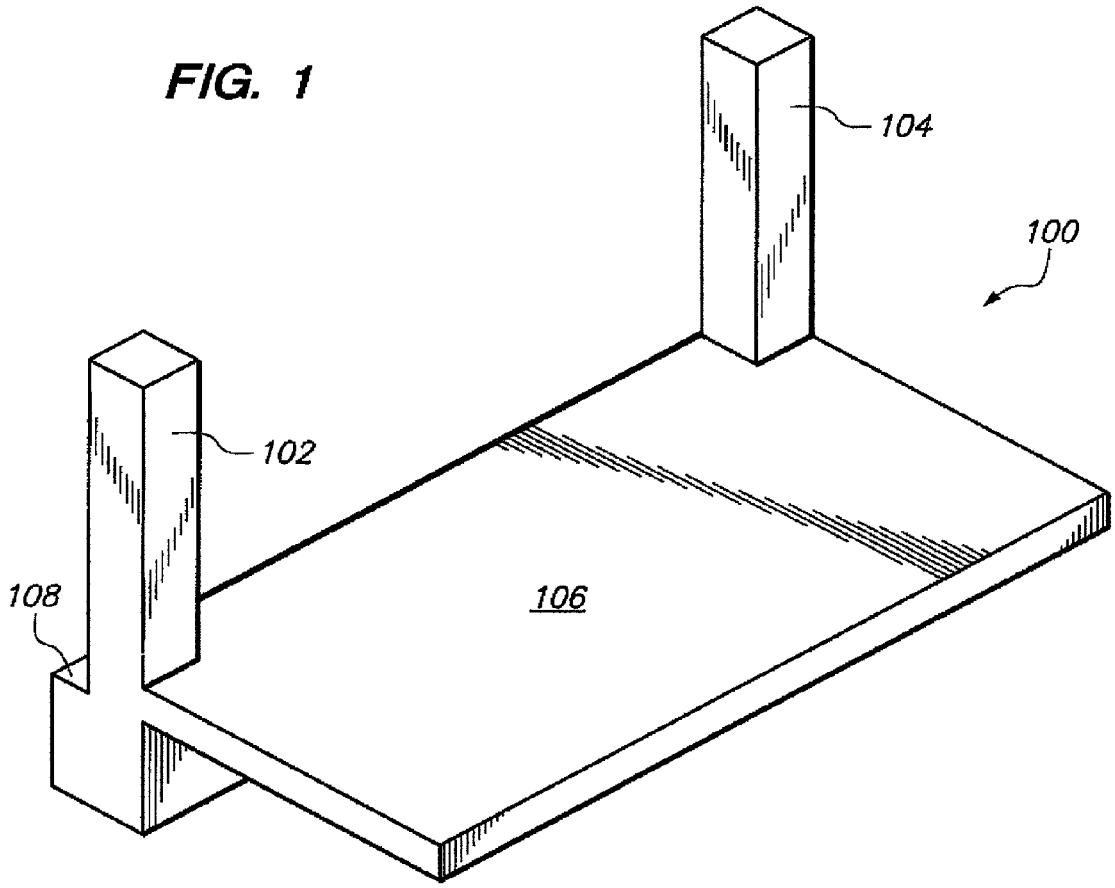
FIG. 1 is a perspective view of a single modular unit according to one embodiment of the invention.
Figure 3:
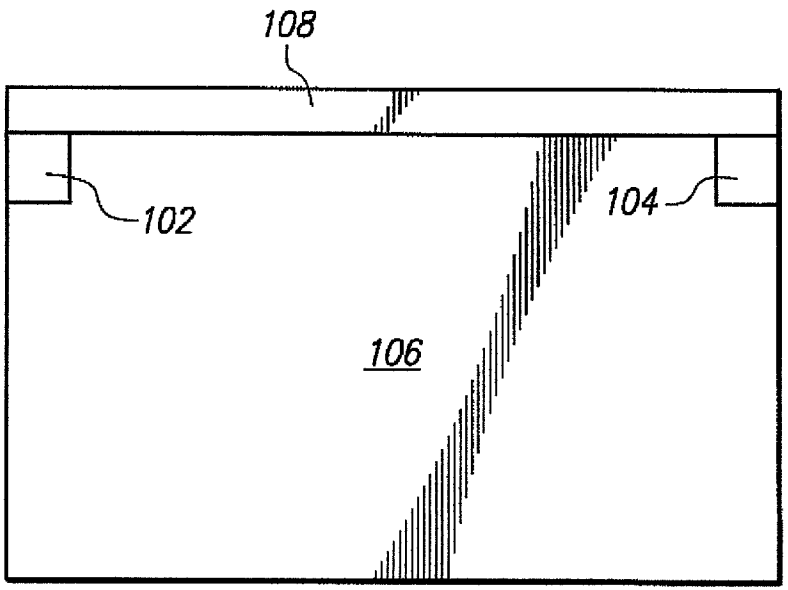
FIG. 3 is a top view of the single modular unit of FIG. 1.
Figure 2:
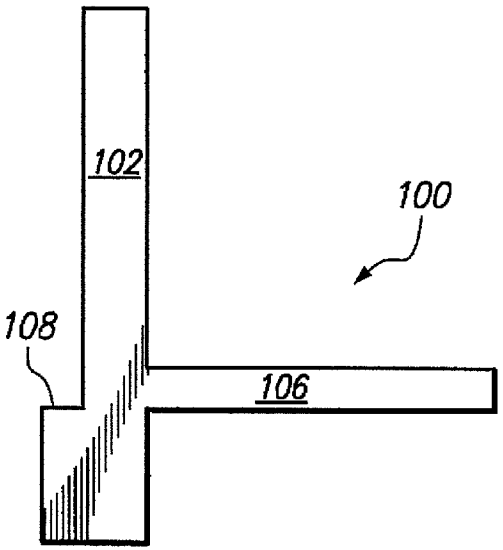
FIG. 2 is a side view of the single modular unit of FIG. 1.

Referring to FIGS. 1-3, in one embodiment, illustrative perspective, side, and top views of a 25 single modular unit (generally 100) are shown. Each modular unit 100 is formed of precast concrete and is prefabricated at a factory prior to shipment to a construction site. The construction of each modular unit 100 conforms to the 2006 International Building Code (IBC) Class 1A construction and fire-resistance standard.

According to one aspect of the invention, each modular unit 100 includes at least two load-bearing self-supporting columns 102 and 104, and a slab/joist section 106. Each slab/joist section 106 includes a receiving lip 108 for coupling to an adjacent slab/joist section.

In one embodiment, the columns 102 and 104 and the slab/joist 106 are precast as one piece. In another embodiment, the columns 102 and 104 are connected to the slab/joist 106 using the connection arrangements discussed below. Likewise, the joist 106 may be cast separately and attached to the slab.

Figure 4:
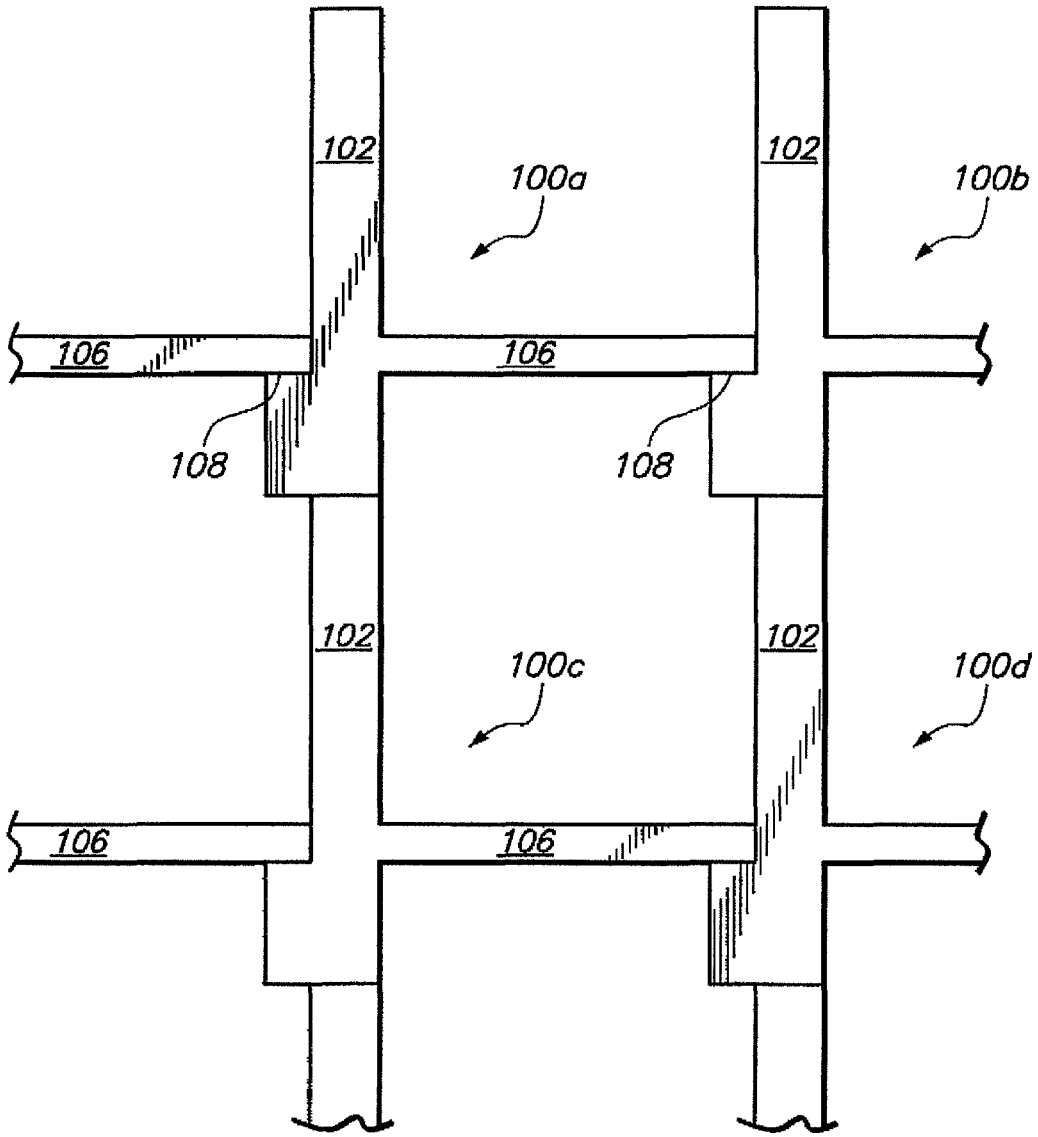
FIG. 4 is a side view of a plurality of modular units connected together, according to one embodiment of the invention.

Referring to FIG. 4, in one embodiment, a plurality of modular units 102 coupled together are shown. In one embodiment, before the modular units 100 are coupled together to form the building, a building foundation is first laid. In other embodiments, no building foundation is necessary.

To assemble the modular units 100 into a building, once the modular units 100 arrive at the construction site, a crane lifts and moves a modular unit 100*a* to an installation location, for example. The units may be arranged to form a ground floor of a building if mounted on foundation elements (see FIG. 4) or a foundation slab. Alternatively, the units may be arranged on an entirely independent ground floor structure, e.g., a commercial space. The modular slab/joist member 106 of a modular unit 100*a* is disposed on top of the column 102 of modular unit 100*c* and the end of the slab/joist member 106 of the modular unit 100*a* is placed on the receiving lip 108 of the modular unit 100*b*. The modular units 100*a*, 100*b*, and 100*c* are coupled together using devices and methods that facilitate assembly and disassembly of the final structure/building without damage to, or destruction of, any of the modular units 100. Examples of such coupling devices and methods are described in detail below. In other embodiments, the modular units 100 are coupled together using other methods known in the art that facilitate disassembly of the final structure/building without damage to or destruction of the modular units 100. Modular units 100 without columns may be used to form a top floor of a building. Alternatively, a conventional ceiling/roof structure may be formed on the uppermost layer of modular units 100.

Figure 5:
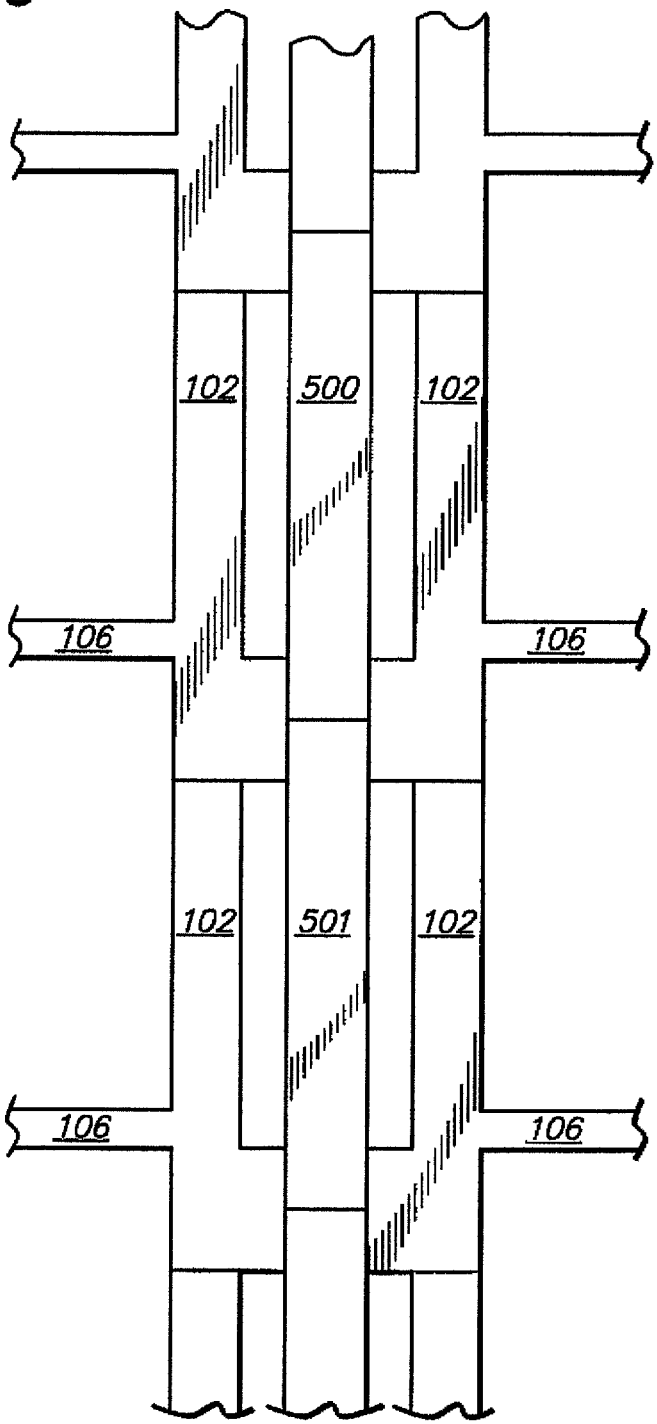
FIG. 5 is a side view of a plurality of modular units and modular shear walls disposed therebetween, according to one embodiment of the invention.

Referring to FIG. 5, a plurality of modular units 100 with load bearing modular shear walls 500 and 501 disposed therebetween is shown. The modular shear walls 500 and 502 are precast units that are pre-fabricated at a factory and shipped to the construction site for installation. The modular shear walls 500 handle tension and compression during seismic activity, and are disposed inside the building in locations that are dependent upon the seismic activity in the geographical area in which the building exists. In various embodiments, the modular shear walls 500 can be disposed in both the X and Y planes of the building and are typically 5-14 feet wide or 5-55 feet wide. The shear walls are connected to each other and/or to the modular unit 100 (e.g., to the columns 104) via an interlocking and connector system such as those described in detail below (see, e.g., FIGS. 7A-7E).

Figure 6:
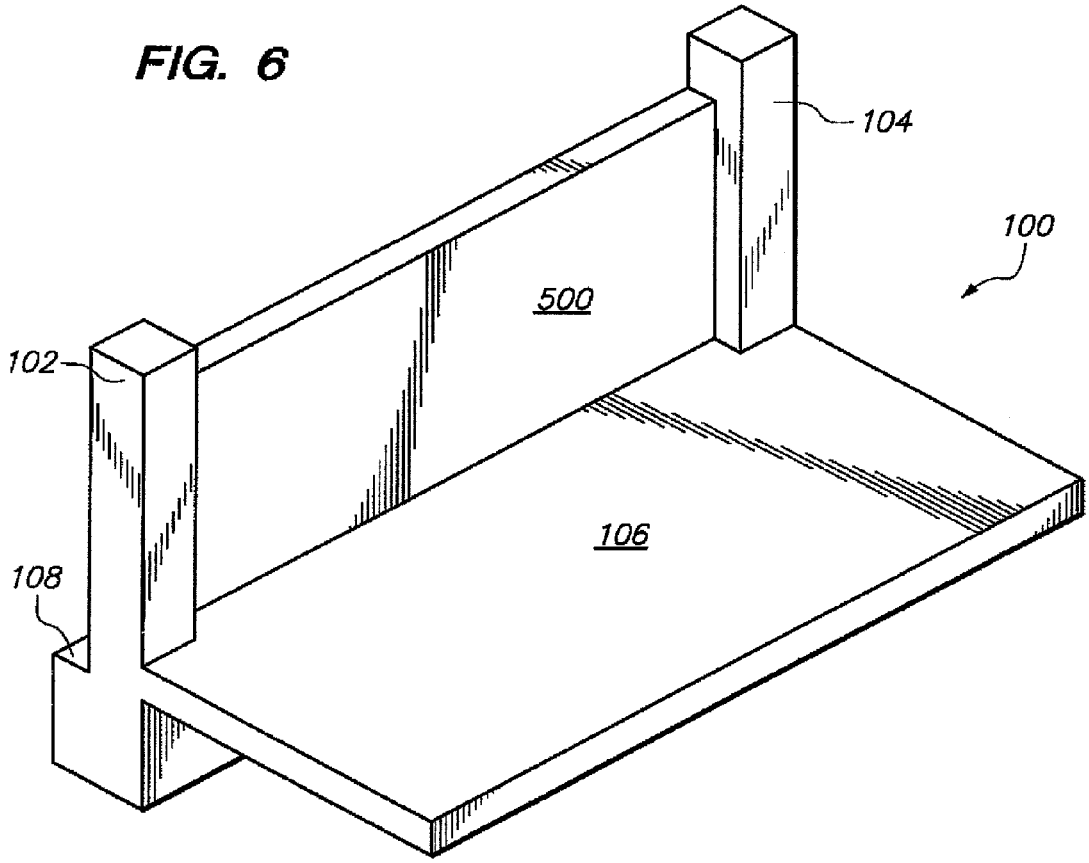
FIG. 6 is a perspective view of a shear wall disposed between two columns, according to one embodiment of the invention.

FIG. 6 shows and alternative embodiment where a shear wall 500 is disposed between the columns 102. Connection devices that can be used for this configuration of the shear wall 500 are described below.

The modular unit 100 is the basic building element for any building. Depending on the type of building to be constructed, the modular unit 100 can be further pre-configured at the factory for a particular building type. For example, the modular unit 100 can be further pre-configured for commercial buildings, such as an office buildings, schools, etc., as shown in FIGS. 8 and 9. Alternatively, the modular unit 100 can be further preconfigured for a residential building, such as an apartment building, as shown in FIGS. 10-14.

Figure 7A:
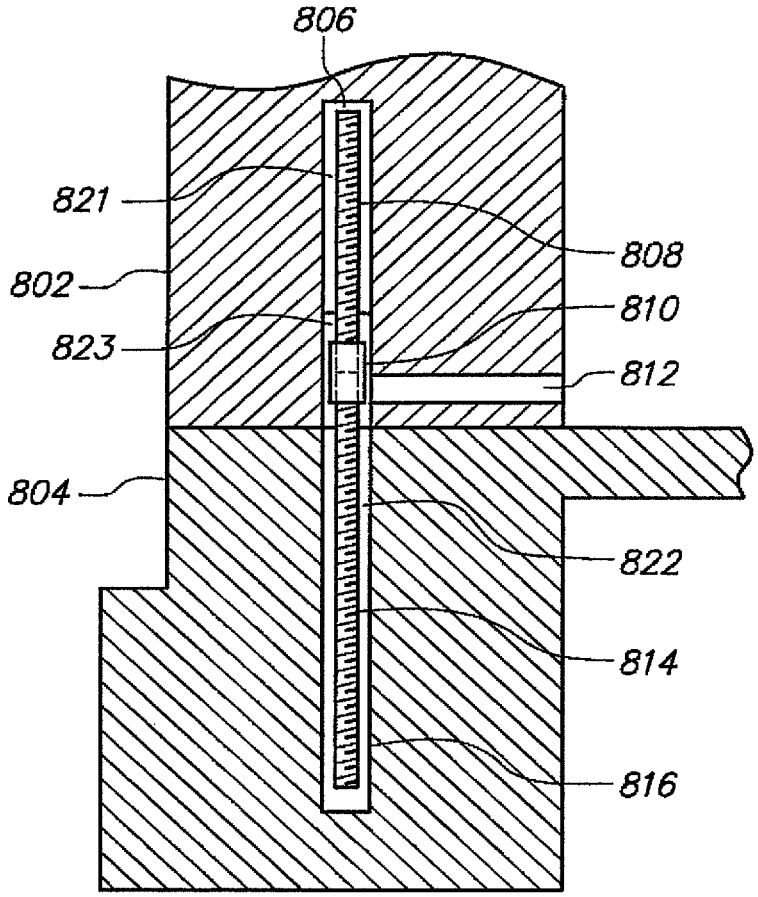
FIG. 7A is a cross-sectional side view of a top column and a joist/bottom column each including a threaded steel rod embedded therein, where the steel rods are coupled together with a threaded coupler, according to one embodiment of the invention.
Figure 7B:
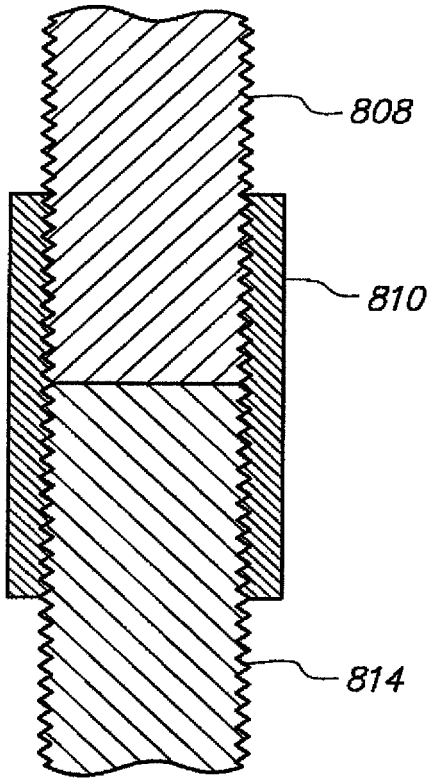
FIG. 7B is a cross-sectional side view of a threaded coupler joining two threaded steel rods together, according to one embodiment of the invention.

Referring to FIGS. 7A and 7B, a cross-sectional side view of a top column 802 and a joist/bottom column 15 804 is shown. The top column 802 includes a steel receptacle 806 embedded therein. A threaded steel bar 808 is disposed in the steel receptacle 806 and surrounded by grout 821 or other cementitious material. The threaded steel bar 808 includes a threaded coupler 20 810 (e.g., a four-inch threaded coupler) that is coupled to the steel bar via threads. The threaded coupler 810 is accessible via access port 812. The threaded coupler 810 is disposed inside the receptacle 806 in an area 823 that is free of grout. Similar connection arrangements, 25 including an access port 812, may be provided at the top and bottom of each column 802. Other types of connecting elements may be used in lieu of threaded bars, such as, for example, solid bars having threaded ends, steel cables (for tension connections, as described below), etc.

The joist/bottom column 804 includes a steel receptacle 816 embedded therein. A threaded steel bar 814 is disposed in the steel receptacle 816 and surrounded by grout 822. The threaded steel bar 814 35 extends out of the steel receptacle 816 so that it can be inserted into the steel receptacle 806 to mate with the threaded coupler 810.

The connection between a column 804 and joist/bottom column 804 is a compression connection, because the weight of the column 804 itself acts to keep the elements connected. Therefore, it is sufficient that the threaded bars on both ends of the connection are fixedly embedded in a cavity of the structures to be connected.

In certain embodiments, a connection arrangement may involve a tension connection, such as, for example, a horizontal connection between two modular units 100 or a connection between a shear wall 500 and a modular unit 100 (discussed below). In such cases, the threaded rod may extend further into the connected structures or may extend through the entire structure, so that a tension force can be sustained by the threaded bar without allowing it to be pulled out of the structure in which it is embedded.

In embodiments in which the threaded bar extends through the entire structure, then non-cementitious material, such as sand, may be used in the cavity surrounding the threaded bar, since the bar will be secured at the opposite end of the structure and axial movement of the threaded bar within the structure is 30 desirable in order to distribute the tension forces. In other words, the use of sand to surround the threaded bar in the cavity will allow tension forces to be borne by the entire length of the threaded rod, because the threaded rod will not be fixed to the walls of the cavity, as in the case of using grout to fill the cavity.

In embodiments in which the threaded bar does not extend through the entire structure, a mechanical anchor, as well as grout or other cementitious material, may be used in a tension connection to secure an internal end of the threaded bar inside a structure to 10 be connected.

To assemble the structure, the column 802 is lowered over, and aligned with, the joist/bottom column 804 so that the threaded steel bar 814 that extends out of the steel receptacle 816 can be inserted into the receptacle 806. The threaded coupler 810 is turned so that it retracts to a position such that it does not extend beyond the end of the steel bar 808. The column 802 is lowered onto the joist/bottom column 804 and the end of the steel bar 814 meets the end steel bar 708.

A tool is then inserted into the access port 812 to turn the threaded coupler 810 and engage the steel bar 814, thereby coupling the steel bars 808 and 814. In one embodiment, the coupler 810 is hex coupler and is turned by a wrench. In another embodiment, the coupler includes holes disposed along its circumference. The holes are adapted to receive a hex square or ⅜" round bar to turn the coupler from the access port.

The result is a rigid structure that includes the upper column 802 and the joist/bottom column 804 held in 30 place by the coupled threaded steel rods 808 and 814. This process is repeated to construct a frame for a modular unit. The access port 812 is covered/sealed with a fireproof plug when not being used.

To disassemble the structure, a tool is inserted 35 into the access port 812 to turn the threaded coupler 810 and decouple the threaded steel rods 808 and 814. Thereafter, the upper column 802 and the joist/bottom column 804 can be separated and reused.

Figure 7C:
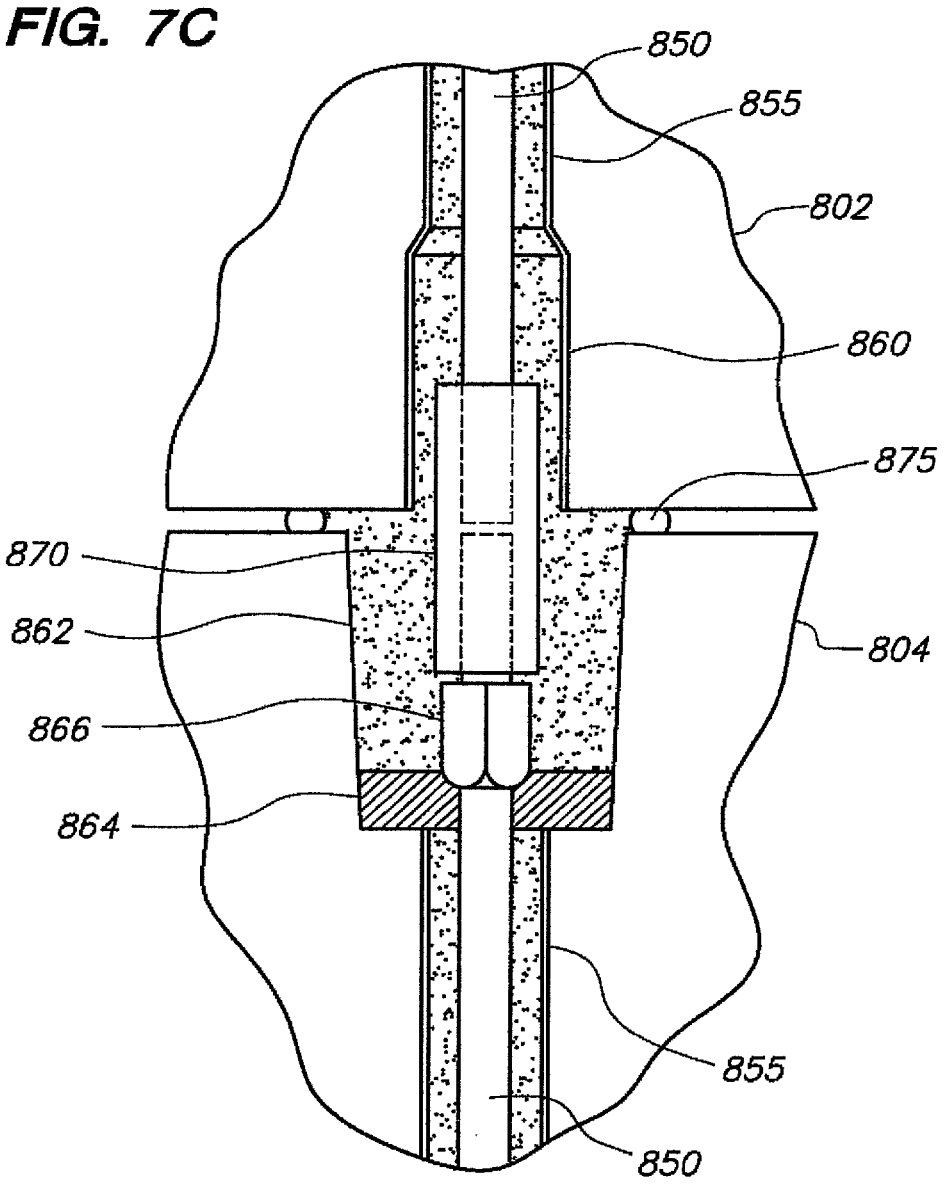
FIG. 7C is a cross-sectional side view of an alternative embodiment of a connection arrangement for a top column and joist/bottom column.

In another embodiment, as shown in FIG. 7C, the structure may be connected using a connecting arrangement that includes threaded steel bars 850 mounted in corrugated metal ducts 855 having flared portions 860 at the connecting ends. One of the metal ducts 855 may include a conical recess 862 at the end and an anchor plate 864 positioned within the recess to support an anchor nut 866 mounted at the end of one of the threaded bars 850. A threaded coupler 870 is used to join the ends of the threaded bars 850 in a manner similar to that described above. The ducts 855 may be filled with sand, e.g., approximately 60 grit sand. A gasket 875 may be positioned between the connected structures. Connecting structures of this type are commercially available, e.g., from Dywidag-Systems International.

As noted above, the upper column 802 may be attached to the joist/bottom column 804 using the connection devices and methods discussed above or the upper column 802 may be precast as part of the modular unit 100.

The connection devices and methods discussed above also may be used to connect the top of the upper column 802 to the joist/bottom column 804 of a second modular unit 100 positioned above the first modular unit 100, i.e., a modular unit that forms the next higher floor in the building. Moreover, these connection devices and methods also may be used to connect shear walls 500 to the modular units 100, as noted above. Thus, these connection devices and methods may be used to form individual modular units 100 as well as to interconnect the modular units 100 to form the building structure.

Figure 7D:
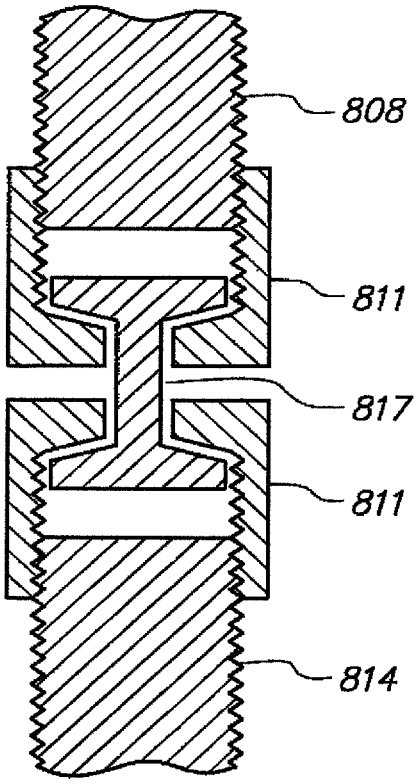
FIG. 7D is a cross-sectional side view of an alternative embodiment of a threaded coupler joining two threaded steel rods in which the coupler is formed of two separate portions joined by a shank.

FIG. 7D is a cross-sectional side view of an alternative embodiment of a threaded coupler 811 joining two threaded steel rods 808 and 814 in which the coupler 811 is formed of two separate portions joined by a shank 817. This arrangement allows for relative movement between the two portions of the coupler 811 in case the threaded rods 808 and 814 are misaligned. Numerous other mechanical configurations of the coupler are also possible that would allow relative motion between the ends thereof to accommodate a misalignment of the threaded rods.

Figure 7E:
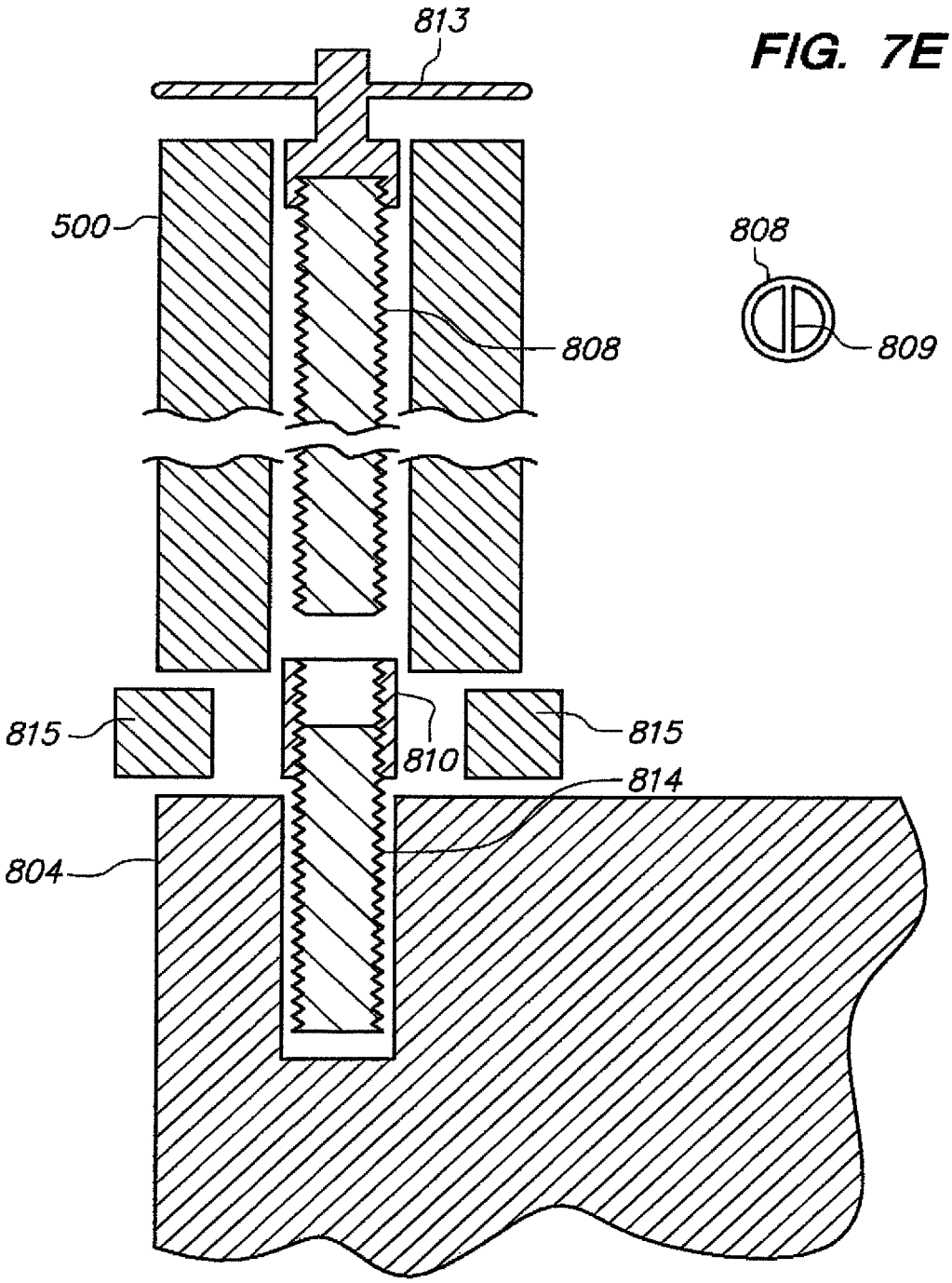
FIG. 7E is a cross-sectional view of a connection arrangement between a shear wall and a modular unit, according to one embodiment of the invention.

FIG. 7E is a cross-sectional view of a connection arrangement between a shear wall 500 and a modular unit 100. For example, a shear wall 500 may be connected to the floor slab or the joist/bottom column 804.

In this embodiment, the threaded bar 808 extends through the entire shear wall 500. A threaded connector 810 is attached to the threaded rod 814 extending from the joist/bottom column 804. The wall 500 is moved into position over the connection point and may be maintained in position by temporary spacer blocks 815 to allow safe access to the connection point. The threaded rod 808 of the wall 500, as noted above, extends through the entire wall and is axially movable so that a tension connection can be formed without applying tension forces to the wall itself. Once the threaded rod 808 is positioned in the opposite end of the connector 810, then a tool, such as a MT-bar" or cross-bar tool 813, may be used to 35 tighten the threaded rod 808 in the connector 810. The threaded bar 808 may include a slot 809, or similar structure, at the end to engage with a corresponding structure in the cross-bar tool 813. An access port 812 (see FIG. 7A) is not necessary in this configuration, but may be included to facilitate assembly and disassembly.

The cavity surrounding the threaded bar 814 of the joist/bottom column 804 may be filled with grout or other cementitious material to secure the threaded bar 814 in place. The cavity surrounding the threaded bar 808 of the wall 500 may be filled with a non-cementitious material, such as sand (e.g., 60 grit sand). This connection arrangement may also be used for compression connections. For example, a column may be connected to the slab using a threaded rod installed in a cavity that passes through the entire column. In such a case, the cavity may be filled partially or completely with grout after the threaded rod is tightened using the cross-bar tool.

Figure 8A:
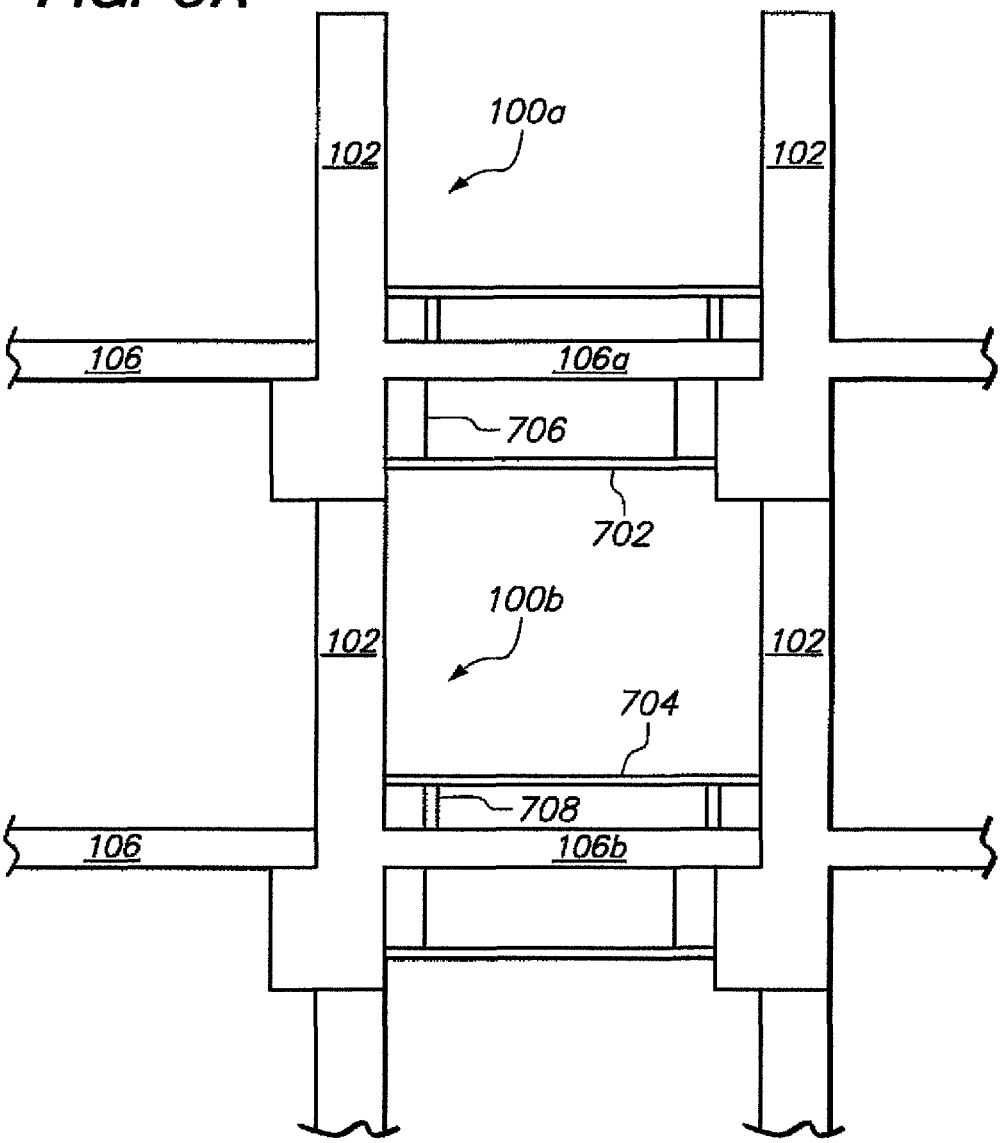
FIGS. 8A and 8B are side views of a plurality of coupled modular units each including a dropped ceiling and a raised floor, according to one embodiment of the invention.
Figure 8B:
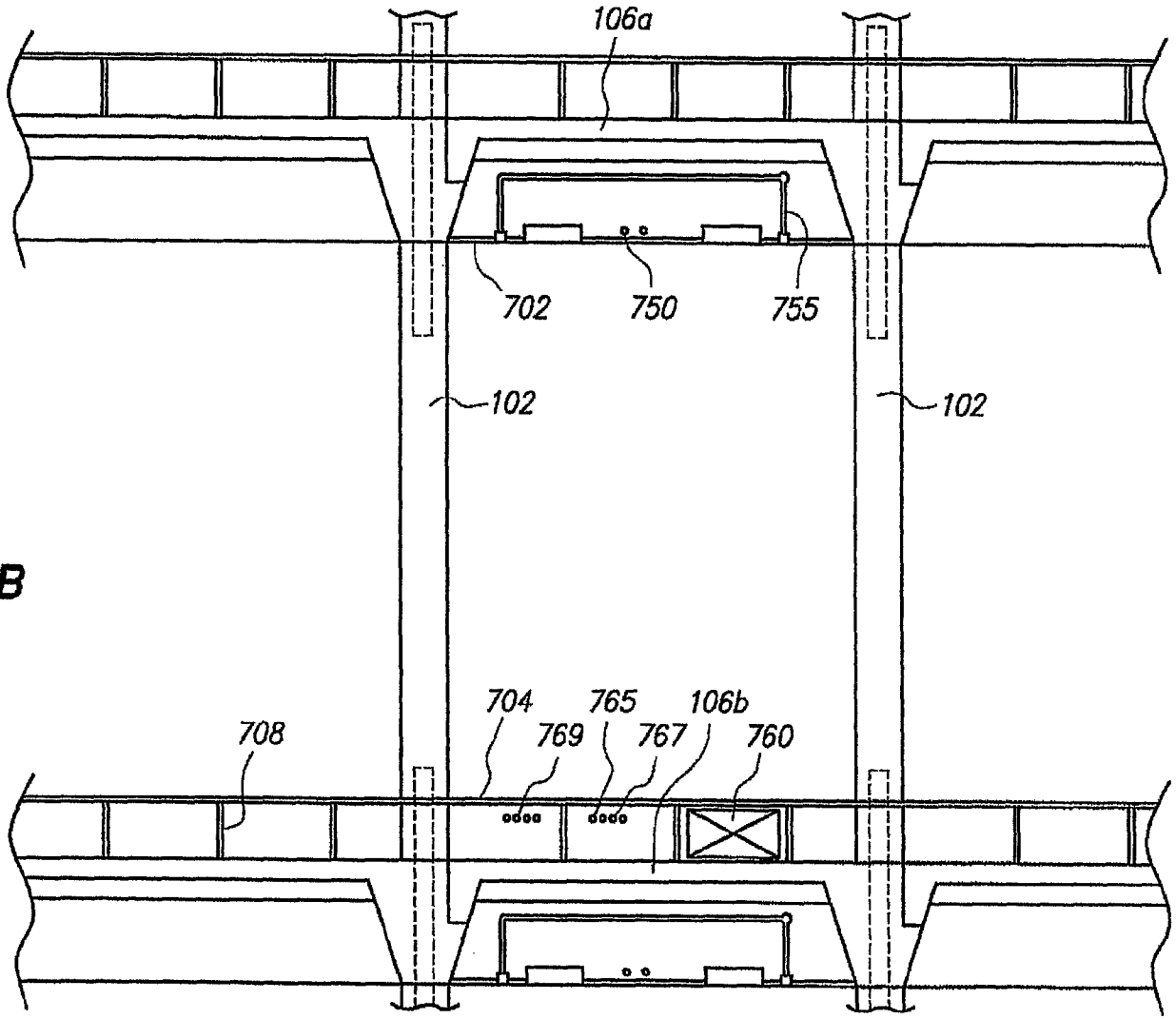
Figure 9:
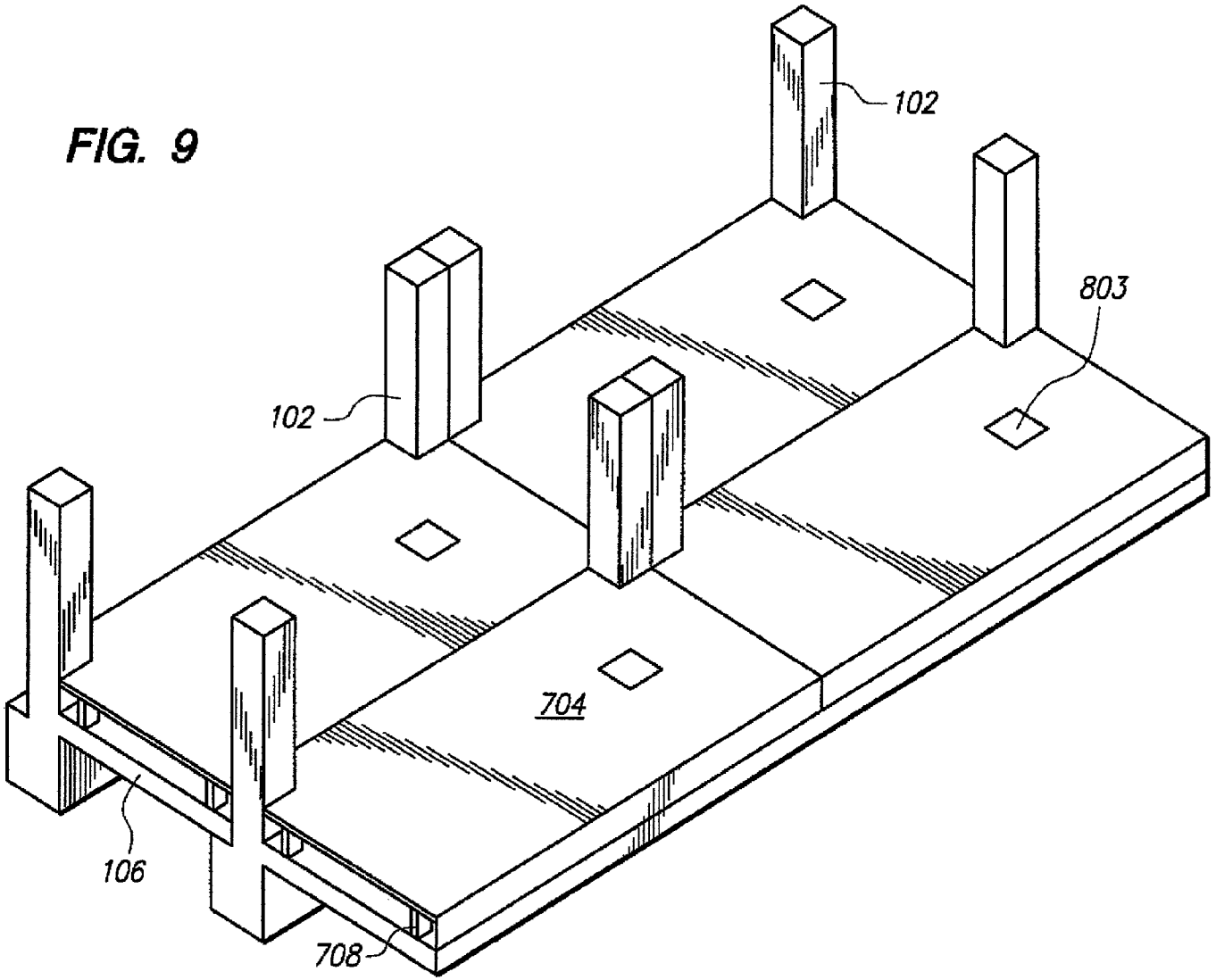
FIG. 9 is a perspective view of plurality of modular units forming a portion of a commercial building floor, according to one embodiment of the invention.

Referring to FIGS. 8A and 8B, a plurality of coupled modular units 100 including a dropped ceiling 702 and a raised floor 704 is shown. This configuration is typically used for modular units that are used in a commercial building, such as an office building. The dropped ceiling 702 may be coupled to the bottom of the slab/joist member 106*a* of the modular unit 100*a* by members 706 or by connection to the columns 102. The raised floor 704 may be coupled to and held above the slab/joist member 106*b* of the modular unit 100*b* by members 708.

Utility elements, such as lighting (and alarm system) connections 750 and fire suppression/sprinkler connections 755 may be stored between the dropped ceiling 702 and the slab/joist member 106*a* of the modular unit 100*a*, and are accessible via an access panel in the dropped ceiling (not shown). Utility elements such as HVAC 760, electrical 765, communication 767, and plumbing connections 769 may be stored between the raised floor 704 and the slab/joist member 106*b* of the modular unit 100*b*, and are accessible via an access panel 803 in the raised floor (see FIG. 9).

Referring to FIG. 9, a plurality of modular units forming a portion of a commercial building floor are shown. Once the plurality of modular units are coupled together to form a floor of the building, optional non-structural elements can be added, such as non-load bearing walls, doors, bathroom fixtures, etc. The non-load bearing walls can be made of precast concrete, drywall, brick, any composite material, or plaster. This modular system allows architectural freedom with respect to dimensions and layout, and is only limited by the required placement of the modular shear walls, which depends on the seismic activity of the particular geographic region.

Further, all the utilities discussed above, which are stored in the above the dropped ceiling or below the raised floor are extended through the access panels and stored in a constructed utility closet.

Figure 10:
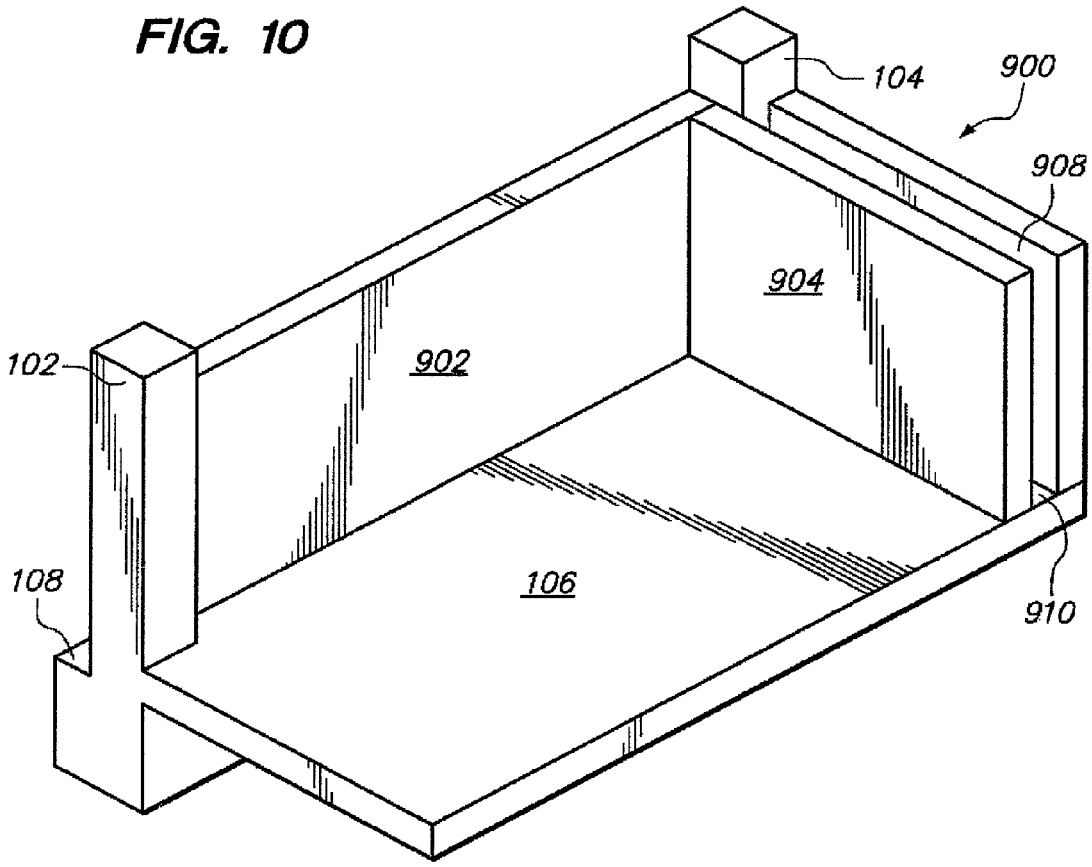
FIG. 10 is a perspective view of a modular unit pre-configured for a residential building, according to one embodiment of the invention.
Figure 11:
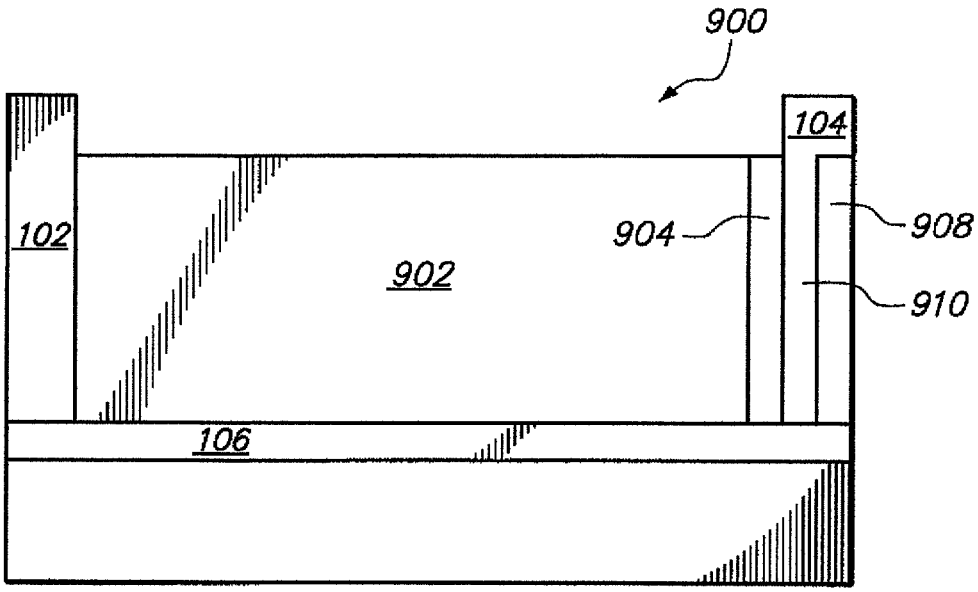
FIG. 11 is a side view of a modular unit pre-configured for a residential building, according to one embodiment of the invention.
Figure 12:
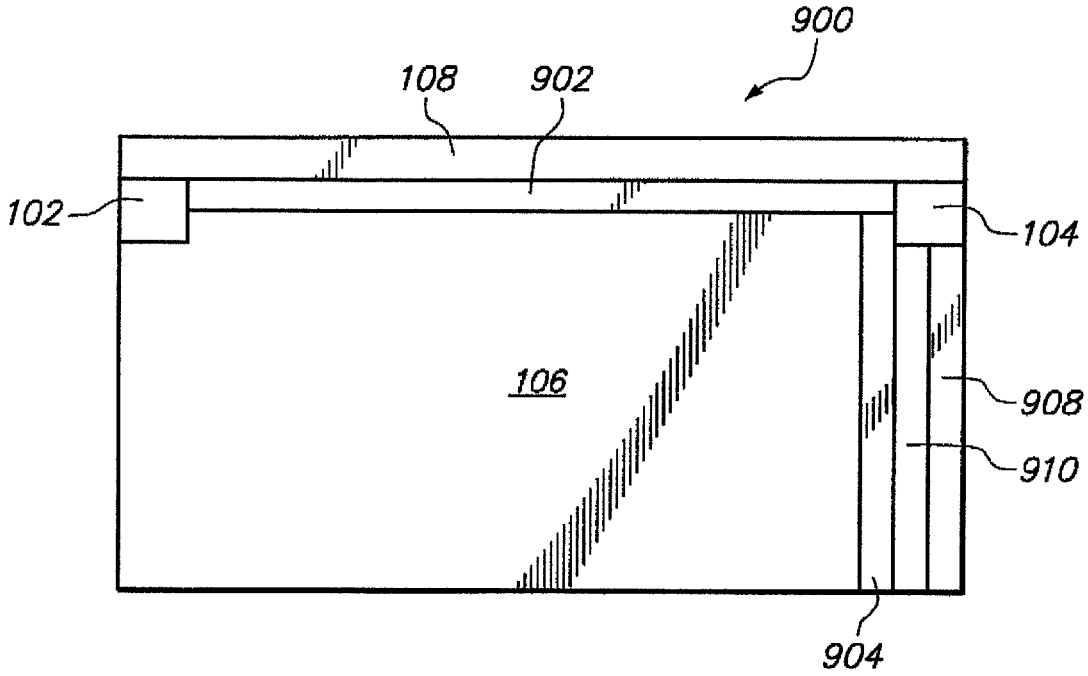
FIG. 12 is a top view of a modular unit pre-configured for a residential building, according to one embodiment of the invention.

Referring to FIGS. 10-12, perspective, side, and top views of a modular unit pre-configured for a residential building is shown. In this embodiment, the modular units 900 are coupled together as described above. However, each modular unit 900 includes other structural elements such as non-load bearing walls 902, 904, and 908. When the modular units are coupled together, the wall 902 and floor section of one modular unit 900 may be shared with an adjacent modular unit 900. In other embodiments, each modular unit 900 includes all four walls. Further, the floor section of a top modular unit also functions as the ceiling section of a lower modular unit.

Each modular unit 900 further includes a utilities section 910 that includes all the apparatus and connections for electric, HVAC, water/plumbing, and any communication connections, such as telephone, LAN, broadband, fiber, and/or cable.

Figure 13A:
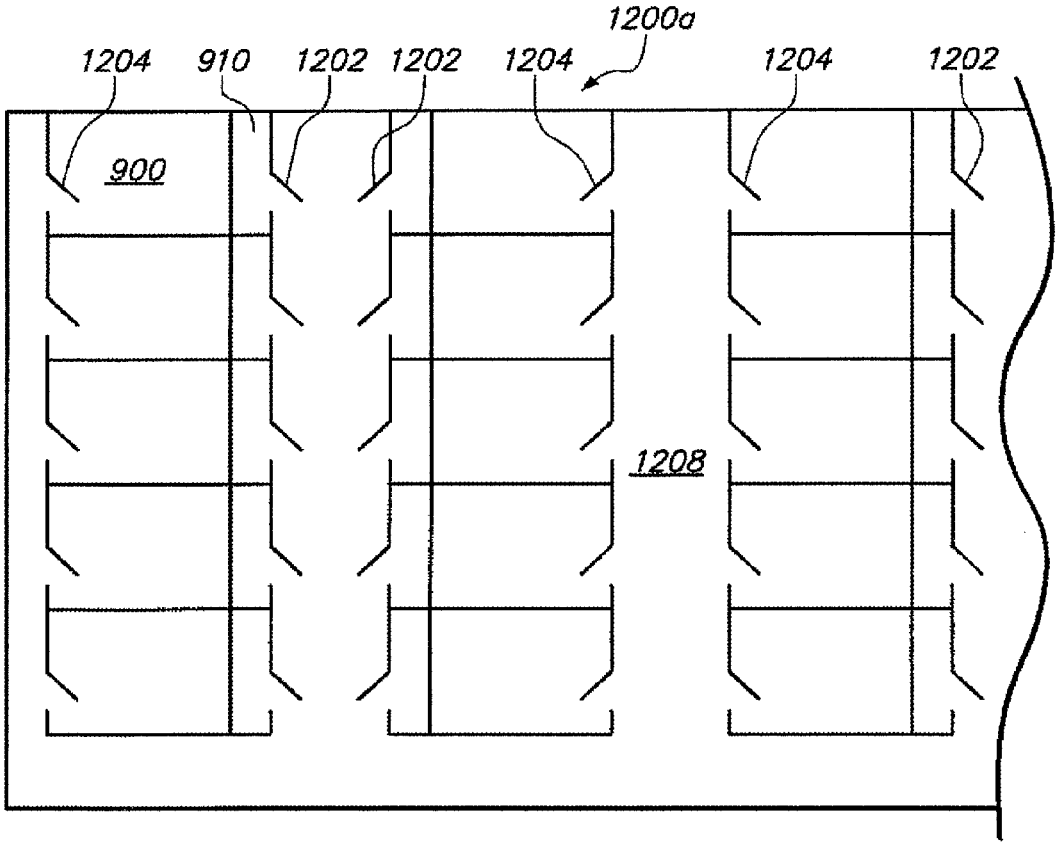
FIGS. 13A, 13B, and 13C are top views of a plurality of residential modular units positioned to form part of a floor of a building, according to various embodiments of the invention.
Figure 13B:
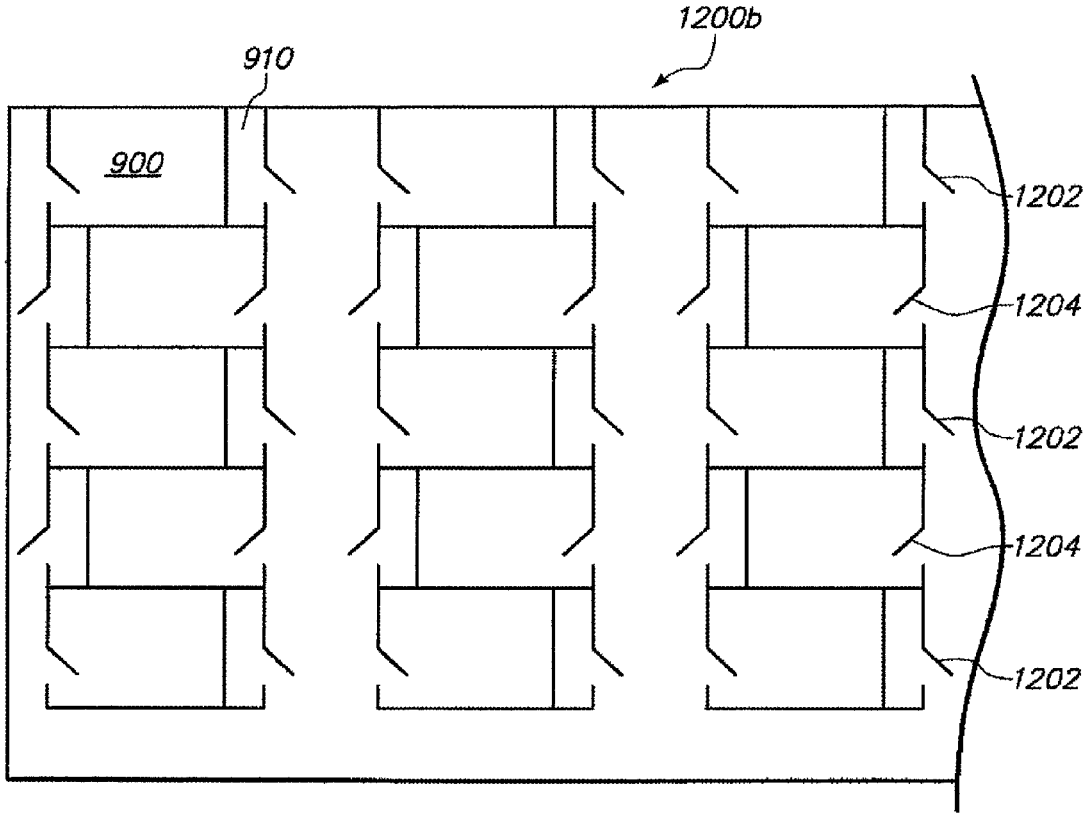
Figure 13C:
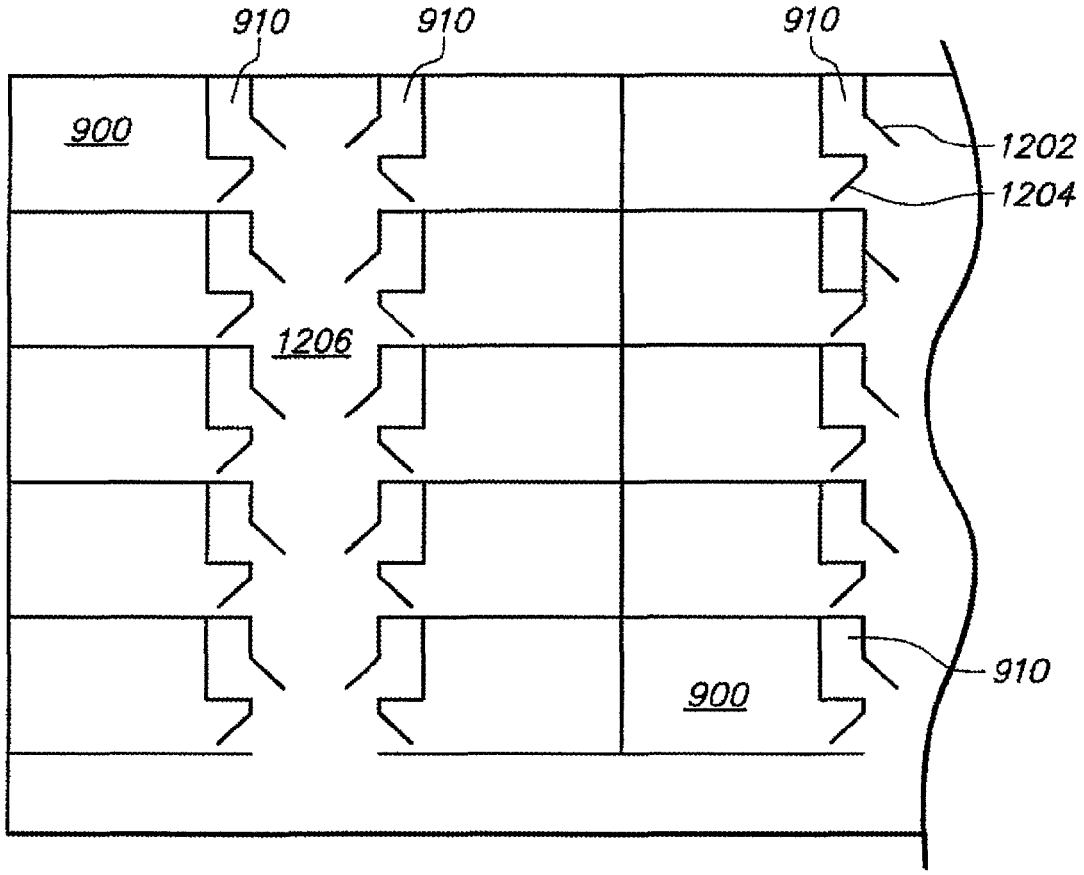

Referring to FIGS. 13A, 13B, and 13C, when all the modular units are in positioned in their permanent positions, the utilities section 910 of each modular unit 900 is accessible via a hallway.

FIG. 13A shows one embodiment of a plurality of modular units 900 positioned to form part of a floor 1200*a* of a modular building. As described above, each modular unit 900 includes a utilities section 910. Each modular unit 900 also includes a door 1204 to the unit itself on one side, and a door 1202 to the utilities section 910 located on the opposite side. In this embodiment, each of the modular units 900 in a row are facing the same way. The modular units 900 are accessible via a hallway 1208 and each of the utilities sections 910 of the respective modular units 900 are accessible via a hallway 910.

FIG. 13B shows another embodiment of a plurality of modular units 900 positioned to form part of a floor 1200*b* of a modular building. As described above, each modular unit 900 includes a utilities section 910. Each modular unit 900 includes a door 904 to the unit itself and a door 1202 to the utilities section 910. In this embodiment, each of the modular units 900 in a row facing in alternate directions. The modular units 900 and the utilities sections 910 are accessible via a hallway 912.

FIG. 13C shows still another embodiment of a plurality of modular units 900 positioned to form part of a floor of a modular building. As described above, each modular unit 900 includes a utilities section 910. Each modular unit 900 includes a door 904 to the unit itself on one side, and a door 1202 to the utilities section 910 located on the same side. In this embodiment, each of the modular units 900 in a row are facing the same way. The modular units 900 and the utilities sections 910 are accessible via a hallway 1206.

Electrical wiring is run in a conduit that is placed in the concrete form before the concrete is poured at the factory. After the concrete is poured and hardens, the conduit is embedded in the resulting concrete slab. The plumbing and mechanical piping and ductwork are installed in conjunction with the finished cabinetry, floors, ceilings, interior walls (dry wall), and appliances. In other words, each modular unit 900 is fully completed before it leaves the factory and is shipped to the construction site.

The above embodiments are only a few of many possible configurations. This modular system allows architectural freedom with respect to dimensions and layout, and is only limited by the required placement of the modular shear walls, which depends on the seismic activity of the particular geographic region.

Figure 14:
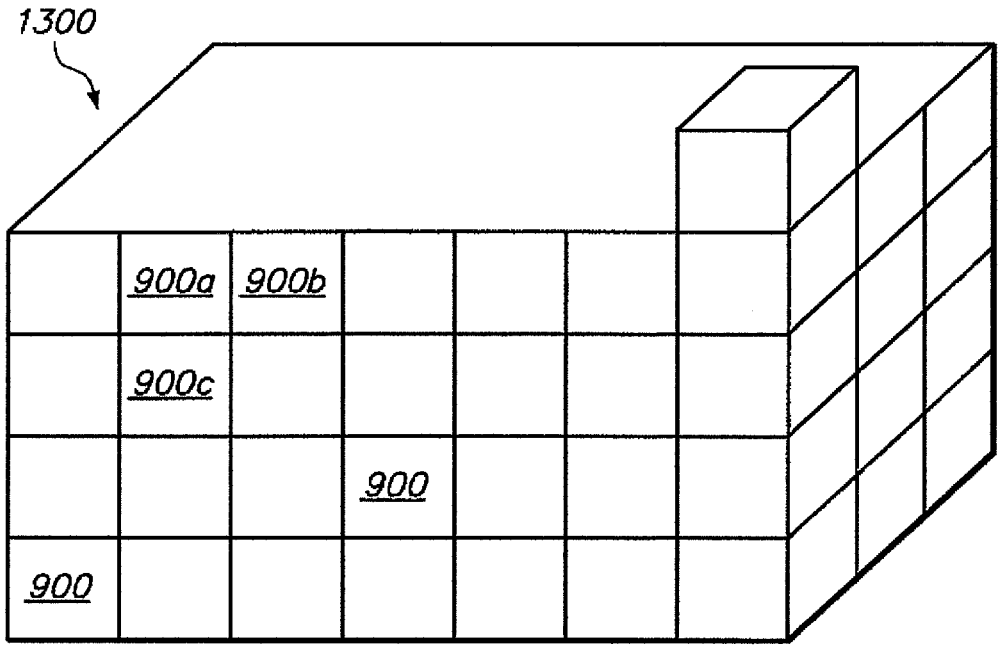
FIG. 14 is a perspective view of a plurality of residential modular units coupled together to form a structure, according to one embodiment of the invention.

Referring to FIG. 14, a plurality of modular units 900 connected together to form a building 1300 are shown. In order to construct the building 1300, the completed modular units 900 are brought to the construction site via flatbed truck (or train, or ship), and lifted off the truck using a crane with a harness or platform hoist assembly coupled thereto. The harness or hoist is lowered over a first modular unit 900 and attached to the modular unit 900. The crane then lifts the modular unit 900 off the flatbed truck and moves the modular unit 900 to a construction/installation location. The modular unit 900 is then lowered into place and the harness or hoist is disconnected. Thereafter, another modular unit 900 is placed next to, or on top of, the first modular unit 900 in the same manner as described above. Adjacent modular units 900*a* and 900*b* share a common wall. The floor of one modular unit 900*a* also functions as the ceiling of an immediately adjacent, lower modular unit 900*c*.

As described above, the various modular units are coupled together using devices and methods that facilitate assembly and disassembly of the final structure/building without damage to, or destruction of, any of the modular units. Examples of such coupling devices and methods are described above with reference to FIGS. 7A-7C. In other embodiments, the modular units are coupled together using other methods known in the art that facilitate disassembly of the final structure/building without damage to or destruction of the modular units 100.

After the modular units 900 are placed and anchored/connected, the utilities are connected. As described above, all of the utilities are located in the utilities section 910. The utilities section 910 is accessible via a hallway running between rows of modular units. Further, in some embodiments, certain utilities, such as plumbing, can be run under raised floors, and certain utilities, such as HVAC and fire sprinklers can be installed above dropped ceilings. Moreover, non-load bearing walls, cabinets, fixtures, and appliances may also be installed in the prefabrication stages.

In some embodiments, depending on the intended height of the building, a foundation is first laid before the first modular unit 900 is installed. In other embodiments, a foundation is not necessary.

The present building system and method saves time over a traditional site built process. Traditional construction methods are a linear process. The present system and method, however, enable a building to be fabricated while the construction site is being prepared. This results in cost savings because of decreased carrying costs. The present system and method also allows the completed project to generate revenue sooner because the building is completed faster.

Figure 15:
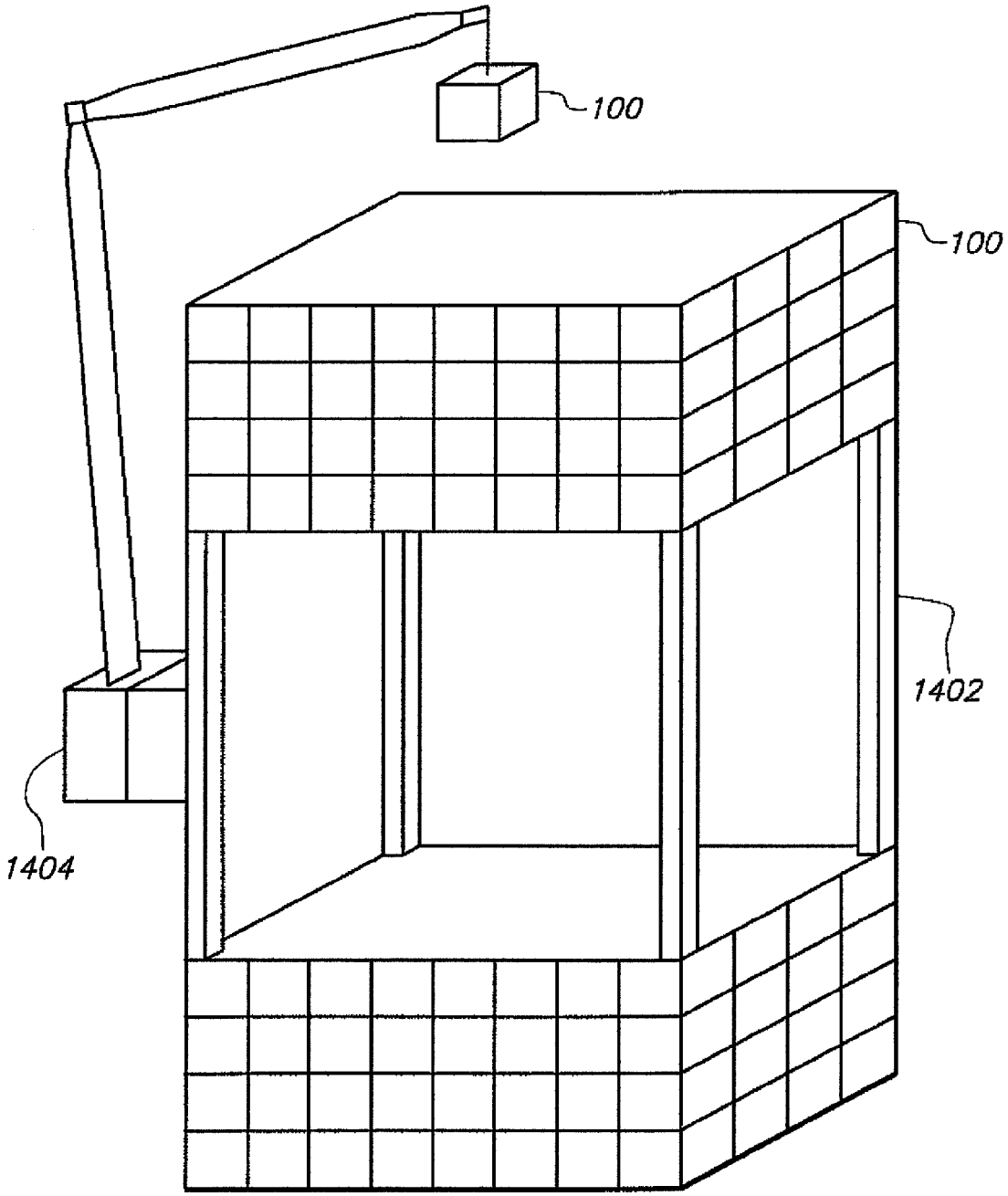
FIG. 15 is a diagram of a crane coupled to a support leg of a modular structure for assembling upper levels/stories of the modular structure, according to one embodiment of the invention.

Referring to FIG. 15, in another embodiment, in order to assemble buildings having over a certain number of floors, a crane 1404 is attached to a column 1402. The crane 1404 can move up or down along the length of the column 1402 as necessary to move a modular unit 100 to a desired installation position on a floor that is beyond the reach of a crane located on the ground floor. In another embodiment, the crane 1404 can be mounted on its own tower.

Figure 16A:
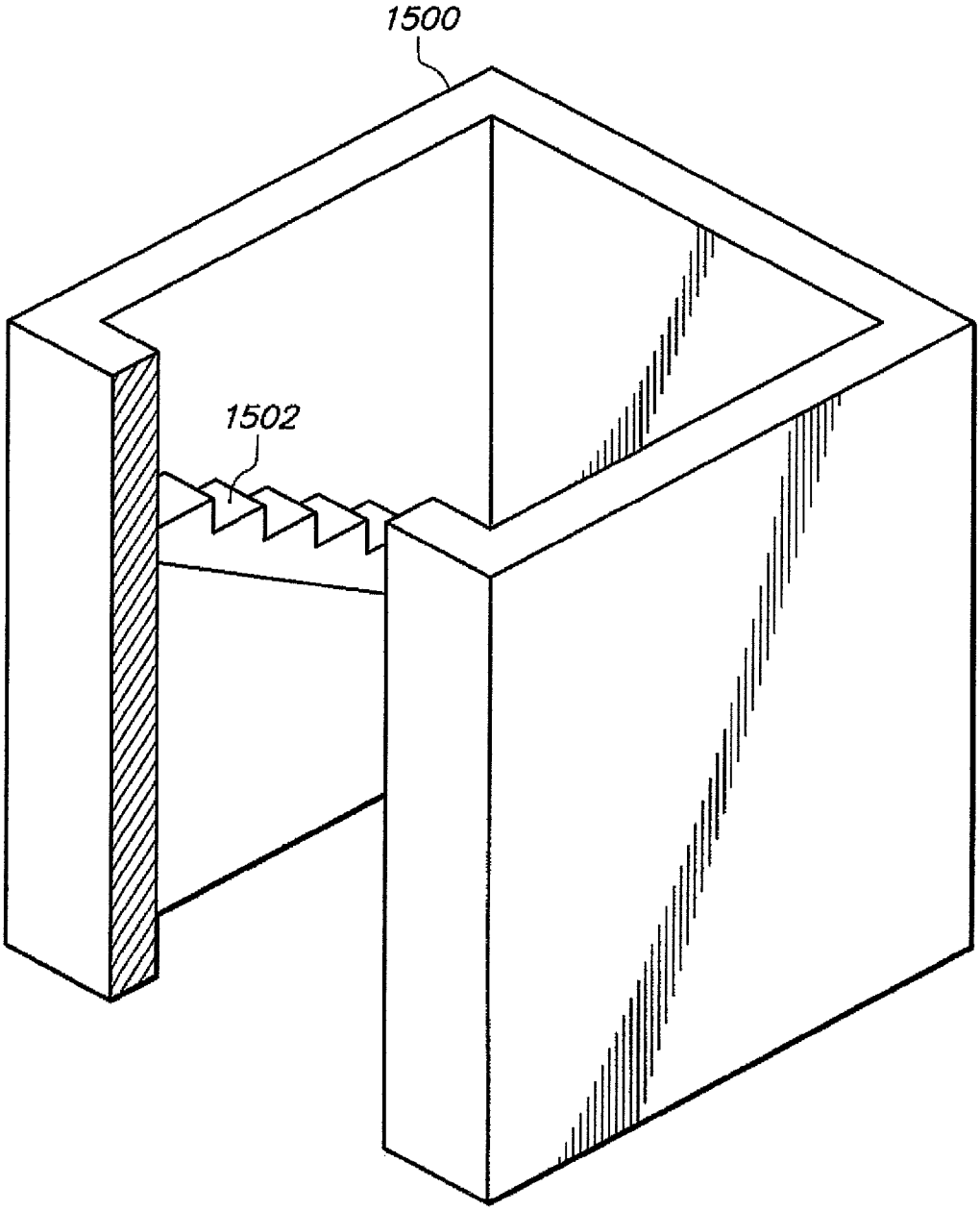
FIG. 16A is a cross-sectional diagram of a shear core with a stair tower disposed therein, according to one embodiment of the invention.
Figure 16B:
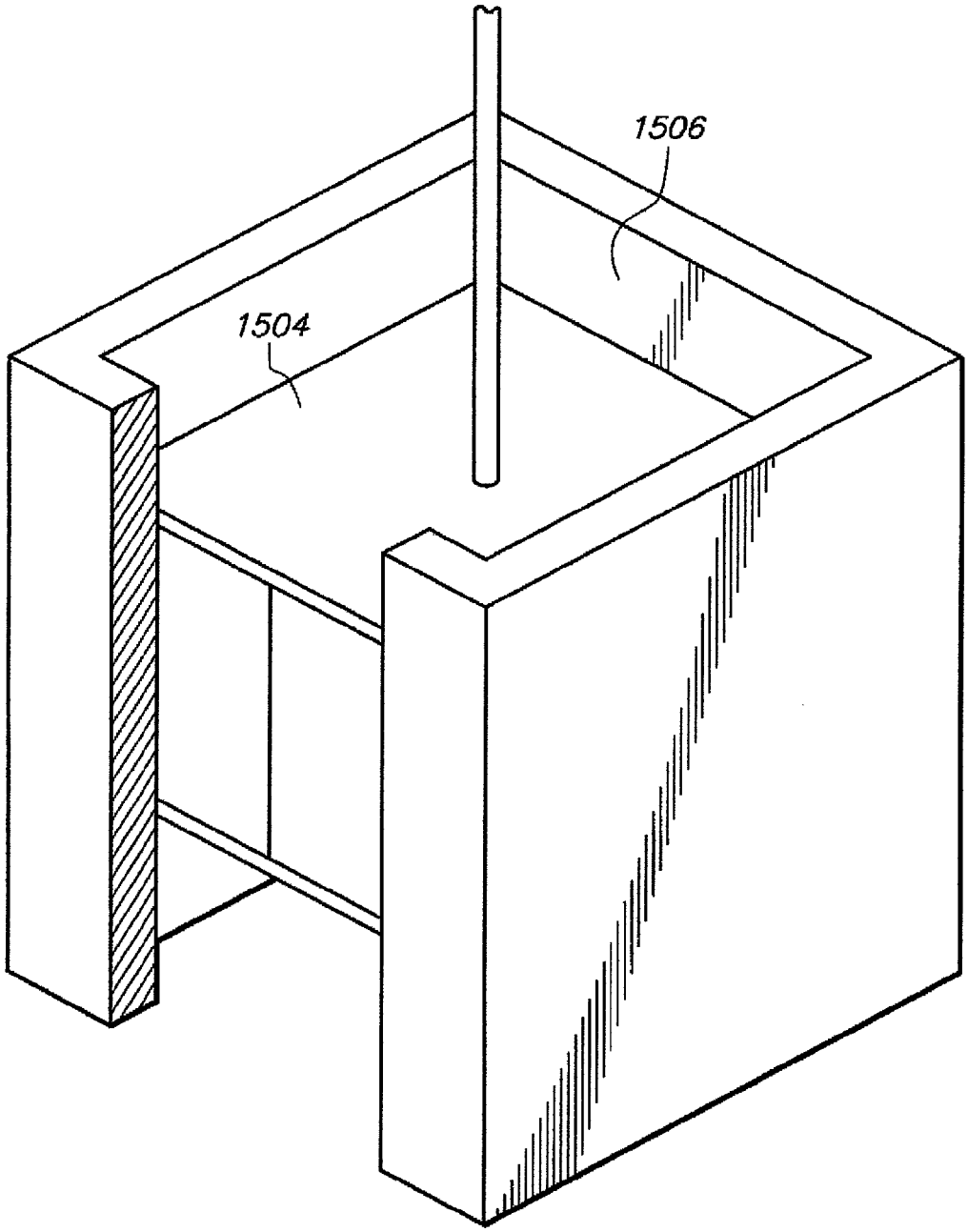
FIG. 16B is a cross-section diagram of a shear core with an elevator shaft disposed therein, according to one embodiment of the invention.

Referring to FIGS. 16A and 16B, in other embodiments, the modular construction system includes a shear core section 1500. The shear core section 1500 is formed of precast concrete and is prefabricated at a factory prior to shipment to a construction site. The shear core section 1500 is used to house a stair tower section 1502 (FIG. 16A) or an elevator shaft 1506 configured to accommodate an elevator 1504 (FIG. 16B).

At the construction site, multiple shear core sections 1500 are stacked on top of one another to form an entire stairwell or elevator shaft. The shear core sections 1500 are connected to one another using any of the connection methods discussed above.

In another embodiment, the crane 1404 can be mounted on the shear core and move up and down the core/shaft as needed for placing modular units.

Figure 17:
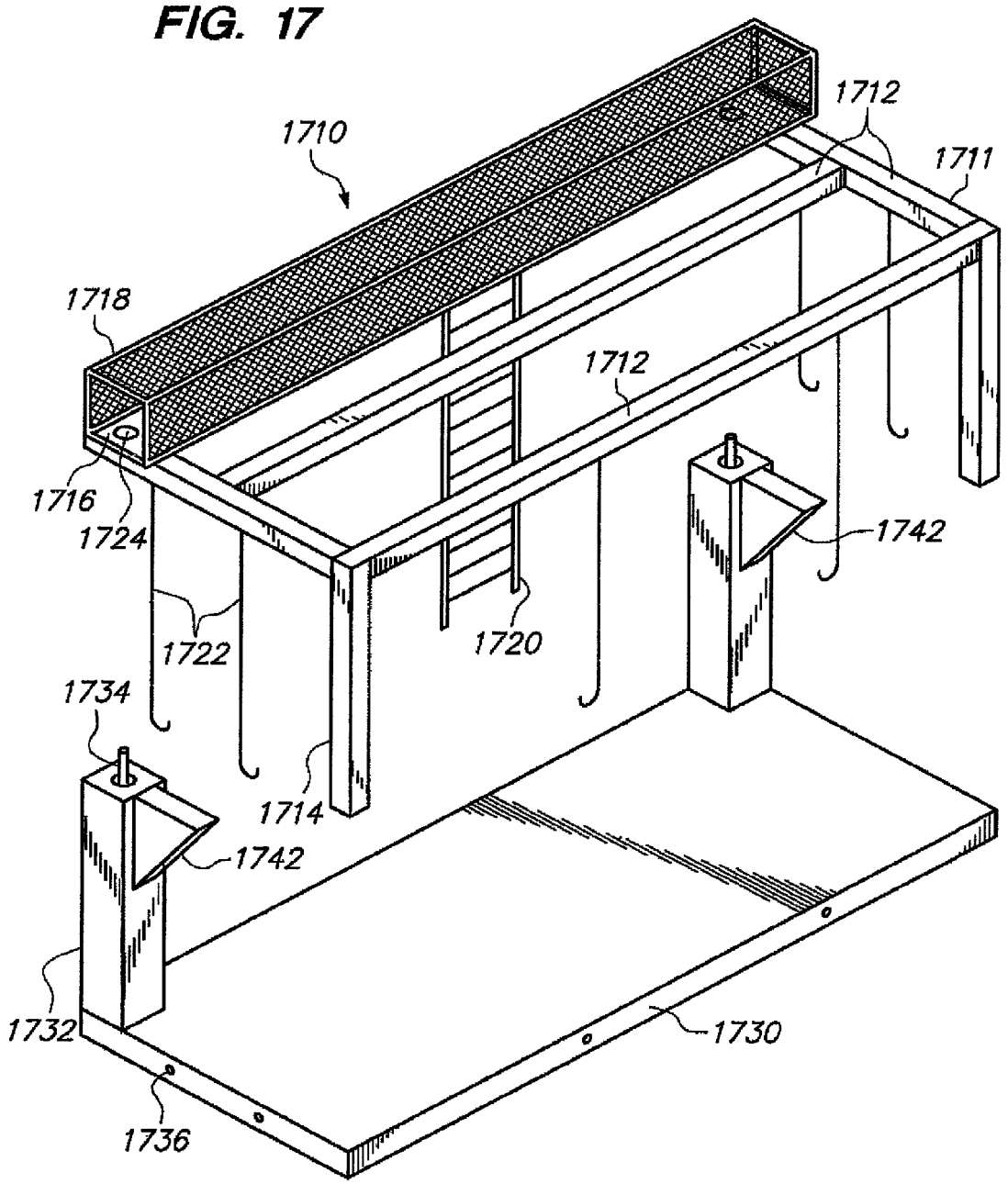
FIG. 17 is a perspective view of a hoist frame and work platform assembly held by a crane and suspended over a modular unit, according to one embodiment of the invention.
Figure 18:
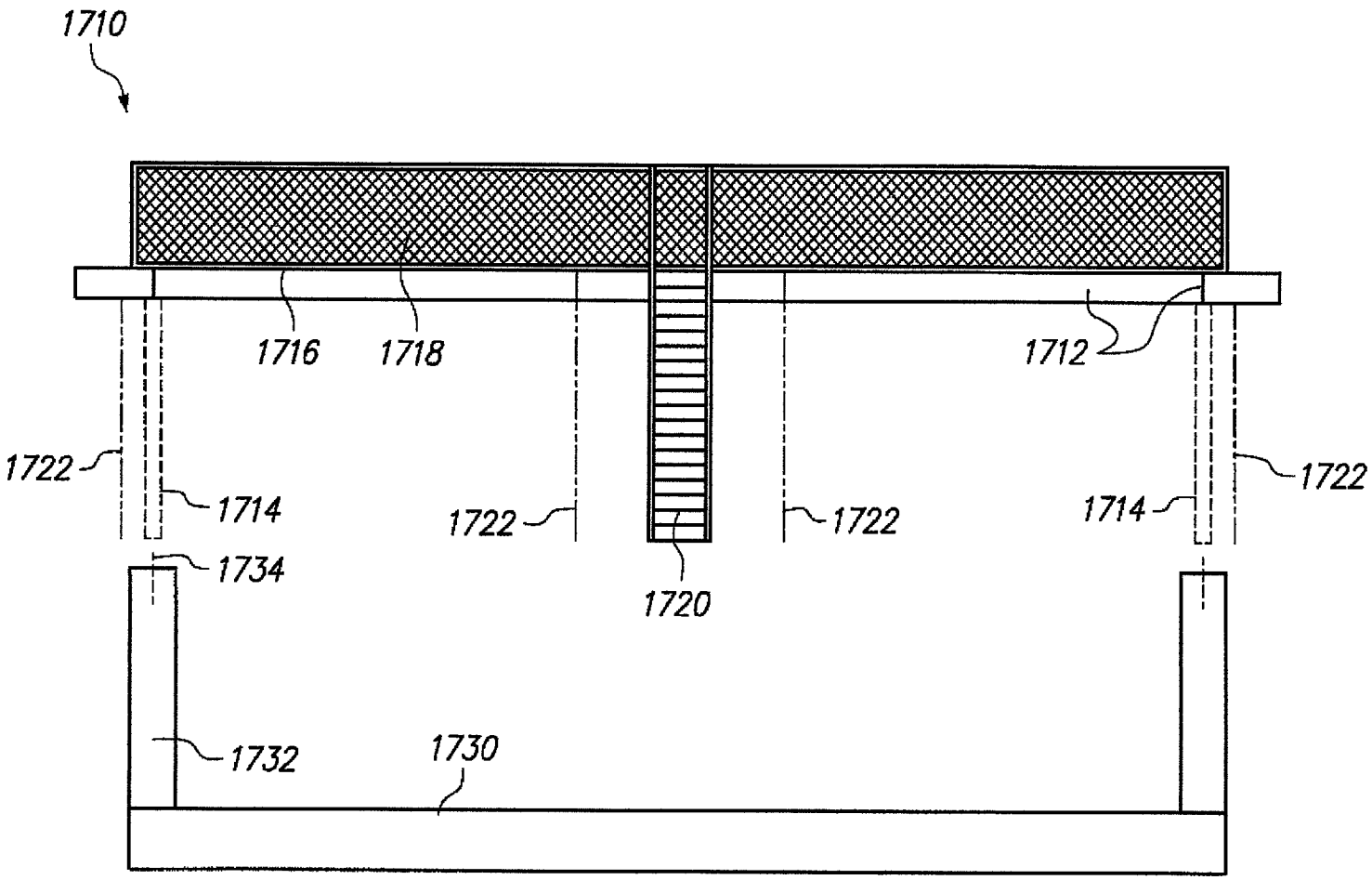
FIG. 18 is a front view of a hoist frame and work platform assembly, according to one embodiment of the invention.
Figure 19:
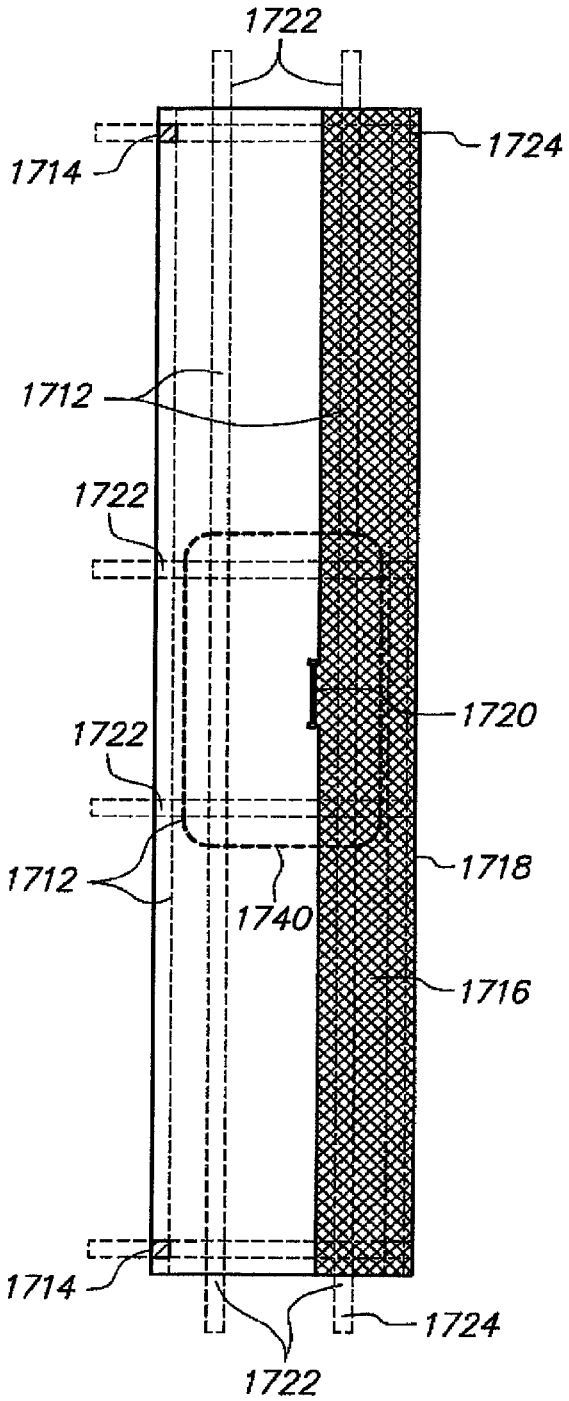
FIG. 19 is a top view of the hoist frame and work platform assembly of FIG. 17.
Figure 20:
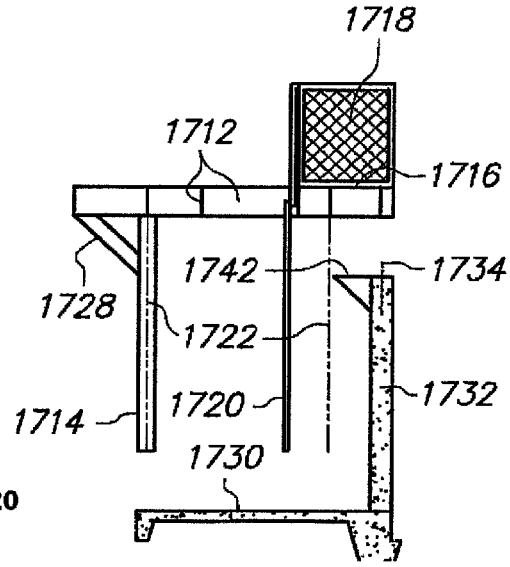
FIG. 20 is a side view of the hoist frame and work platform assembly of FIG. 17.

Referring to FIG. 17, a hoist frame and work platform assembly may be used to move and assemble modular units. In the example depicted, the hoist frame and work platform assembly 1710 are held by a crane and suspended over the slab 1730 of a modular unit having two columns 1732.

Referring to FIGS. 17-20, in one embodiment, the hoist frame and work platform assembly 1710 includes a plurality of beams 1712 configured and arranged to form a square or rectangular shaped frame 1711. A work platform 1716 is disposed long one edge of the frame 1711. The work platform 1716 includes an access hole 1724 on each end, is surrounded by a safety railing 1718, and is accessed via a ladder 1720. Support legs 1714 are disposed on corners of the frame 1711 that are opposite to the work platform 1716. Tie down cables 1722 are disposed along the perimeter of the frame 1711.

In operation, in one embodiment, crane cables (not shown) are attached to the hoist frame and work platform assembly 1710 at "pick points," i.e., balance points determined by the center of gravity, which allow the modular unit 100 to remain balanced while being lifted. The platform 1710 is lowered onto a slab 1730 that has two columns 1732 already lowered into place, which are, however, not yet anchored. The side of the platform 1710 that includes the work platform 1716 is lowered to rest on the columns 1732 such that threaded rods 1734 protruding from the ends of the columns 1732 extend through the access holes 1724. Further, the side of the platform that includes two support legs 1714 is lowered so that the support legs 1714 rest on the slab 1730.

Each of the plurality of tie down cables 1722 is connected to the slab 1730 at tie down points 1736 (FIG. 17). Workmen, using the ladder 1720 to access the work platform 1716, access the threaded rods 1734 to secure the columns 1732 to the work platform 1716. At this point, the platform 1710 is secured to the slab 1730 and the columns 1732.

The crane then lifts the platform 1710 while it is anchored to the slab 1730 and the columns 1732 and moves 30 the entire modular assembly to another location for installation.

After the entire modular assembly has been placed in its final installation position, workmen, using the ladder 1720 to access the work platform 1716, access the threaded rods 1734 and detach them from the platform and add grout or other locking/anchoring means to secure the columns 1732 in place. Thereafter, the tie down cables 1722 are detached from the slab 1730 and the platform 1710 is lifted off the column-slab assembly and moved to another location (via a crane connected to the pick point) for further installation of other modular building units.

In still another embodiment, the hoist frame and work platform assembly 1710 can be connected to a crane, lifted up, and lowered over a modular unit slab alone with columns that have yet to be installed. The tie down cables 1722 are connected to the slab at the tie down points 1736. Thereafter, the crane lifts the platform 1710 along with the slab so that the slab can be moved to another location for installation.

In yet another embodiment, the hoist frame and work platform assembly 1710 can be connected to a crane, lifted up, and lowered over a pair of concrete columns that have yet to be installed. In this case, the columns, standing vertically, are spaced apart from each so that when the platform 1710 is lowered over them, the threaded rods (e.g., rods 1734) extend through the access holes 1724. The columns are anchored to the platform 1710 so that the columns can be lifted and moved to another location (i.e., onto a concrete slab) for installation.

In some embodiments, the platform 1710 is made of steel, and the tie down cables 1722 are made of braided steel cables that include hooks or bolts disposed at the ends used for anchoring the platform 1710 to a concrete slab.

In another embodiment, the platform 1710 is lowered onto, and anchored to, a column-slab assembly at a staging site. In this case, the safety railings 1718 are folded down flat against the work platform 1716 and secured, and the ladder 1720 is folded or disconnected and secured to a part of the platform. The entire platform/column-slab assembly is covered with a tarp and shipped to an installation site.

In still another embodiment, one or more additional braces 1742 (FIG. 17) can be attached to each column 1732 and the corresponding beam 1712 for added support of the hoist frame and work platform assembly 1710.

Variations, modifications, and other implementations of what is described herein may occur to those of ordinary skill in the art without departing from the spirit and scope of the disclosed subject matter. Further, the various features of the embodiments described herein also can be combined, rearranged, or separated without departing from the spirit and scope of the disclosed subject matter. Accordingly, the invention is not to be defined only by the preceding illustrative description.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed:

1. A modular building system for constructing a multi-story building, the system comprising:

a plurality of prefabricated modular units, each modular unit comprising a unitary horizontal concrete slab for forming a floor of the building, a concrete joist portion extending horizontally along a first edge of the slab, the joist portion extending below the slab and having a lip portion that extends horizontally beyond the first edge of the slab, in a first direction perpendicular to the first edge of the slab, to form a receiving lip, a plurality of concrete columns positioned on top of the slab along the first edge, and a plurality of connectors installed in cavities formed in the modular unit, wherein the slab and the joist portion form a bottommost portion of each modular unit, and wherein the horizontal concrete slab extends further than the joist portion in a second direction, opposite the first direction, ending at a free end of the slab having a second edge, wherein at least one floor of the multi-story building is formed by arranging the modular units so that the second edge at the free end of the slab of a first modular unit is positioned on the receiving lip of the first edge of a second modular unit such that the unitary slab of the first modular unit spans an entire distance to the second modular unit, and at least one additional floor of the multi-story building is formed by arranging the modular units so that the joist portion of an upper modular unit is positioned on the columns of a lower modular unit.

2. The system of claim 1, wherein the joist portion is cast as part of the modular unit.

3. The system of claim 1, wherein the joist portion is cast separately from the modular unit and attached to the modular unit.

4. The system of claim 1, wherein the columns are cast as part of the modular unit.

5. The system of claim 1, wherein the modular units are formed of cast concrete.

6. The system of claim 1, wherein the columns are cast separately from the modular unit and attached to the modular unit.

7. The system of claim 6, wherein at least one of the columns comprises a connector arrangement including a cavity, of the cavities formed in the modular unit, that passes completely through the column for receiving a connecting element, the connecting element being movable within the cavity.

8. The system of claim 1, wherein each of the connectors comprises a connecting element fixed within a corresponding cavity, of the cavities formed in the modular unit, the connecting elements being arranged such that the connecting elements of the connectors of adjacent modular units can be joined with a coupler.

9. The system of claim 8, wherein the connecting element is a threaded rod.

10. The system of claim 8, wherein the coupler is configured to allow connected ends of the coupler to move with respect to one another.

11. The system of claim 1, wherein at least one modular unit of the plurality of prefabricated modular units further comprises a prefabricated wall connected to the columns of the modular unit.

12. The system of claim 11, wherein the prefabricated wall comprises a connector arrangement including a cavity, of the cavities formed in the modular unit, that passes completely through the prefabricated wall for receiving a connecting element, the connecting element being movable within the cavity.

13. The system of claim 1, wherein at least one modular unit of the plurality of prefabricated modular units further comprises a plurality of prefabricated walls connected to the columns of the modular unit, the prefabricated walls being arranged to form a utilities section between two parallel walls at an end of the modular unit.

14. The system of claim 13, wherein a plurality of modular units having utility sections are arranged in a row with the utility sections being aligned to allow access to the utility sections from a common hallway.

15. The system of claim 14, wherein the common hallway also provides access to defined entrances of the modular units.

16. The system of claim 1, wherein at least one modular unit of the plurality of prefabricated modular units further comprises a raised floor above the slab.

17. The system of claim 16, wherein utility elements are installed between the raised floor and the slab during fabrication of the modular unit.

18. The system of claim 1, wherein at least one modular unit of the plurality of prefabricated modular units further comprises a dropped ceiling below the slab.

19. The system of claim 18, wherein utility elements are installed between the dropped ceiling and the slab during fabrication of the modular unit.

20. The system of claim 1, further comprising a plurality of prefabricated core units, each core unit being formed by a plurality of walls on three sides and a portion of a fourth side.

21. The system of claim 20, wherein the core units are connected together to form a stack for a stair tower or elevator shaft.

22. The system of claim 1, further comprising:

a hoist frame having a first end configured to attach to the columns of the modular unit;

a plurality of supports configured to hold a second, opposite end of the hoist frame in position above the slab; and a plurality of ties attached to the hoist frame and configured to attach to the slab of the modular unit.

23. The system of claim 22, wherein the hoist frame comprises an accessway arranged between tops of the columns.

* * * * *